US007410247B2

(12) United States Patent
Eguchi et al.

(10) Patent No.: US 7,410,247 B2
(45) Date of Patent: Aug. 12, 2008

(54) LIQUID EJECTION HEAD AND LIQUID EJECTION APPARATUS

(75) Inventors: Takeo Eguchi, Kanagawa (JP); Manabu Tomita, Kanagawa (JP); Kazuyasu Takenaka, Tokyo (JP); Takaaki Miyamoto, Kanagawa (JP); Shogo Ono, Kanagawa (JP)

(73) Assignee: Sony Corporation, Tokyo (JP)

( * ) Notice: Subject to any disclaimer, the term of this patent is extended or adjusted under 35 U.S.C. 154(b) by 244 days.

(21) Appl. No.: 11/036,278

(22) Filed: Jan. 14, 2005

(65) Prior Publication Data

US 2005/0179734 A1 Aug. 18, 2005

(30) Foreign Application Priority Data

Jan. 22, 2004 (JP) ..... 2004-014183

(51) Int. Cl.
*B41J 2/05* (2006.01)
*B41J 2/04* (2006.01)

(52) U.S. Cl. ..... 347/65; 347/54; 347/56; 347/63; 347/67

(58) Field of Classification Search ..... 347/54–67
See application file for complete search history.

(56) References Cited

U.S. PATENT DOCUMENTS 4,835,553 A * 5/1989 Torpey et al. ..... 347/65
5,847,737 A * 12/1998 Kaufman et al. ..... 347/94
6,045,214 A * 4/2000 Murthy et al. ..... 347/47
6,053,599 A * 4/2000 Maeda ..... 347/65
6,074,050 A * 6/2000 Perez et al. ..... 347/86
6,139,761 A 10/2000 Ohkuma
6,283,584 B1 * 9/2001 Powers et al. ..... 347/65
6,312,112 B1 * 11/2001 Pietrzyk ..... 347/65
6,409,318 B1 * 6/2002 Clark ..... 347/65
6,450,625 B1 * 9/2002 Fujii et al. ..... 347/70

(Continued)

FOREIGN PATENT DOCUMENTS

EP 0627318 12/1994

(Continued)

OTHER PUBLICATIONS

Gary Siewell et al., The ThinkJet Orifice Plate: A Part With Many Functions:, Hewlett-Packard Journal May 1985, pp. 33-37.

*Primary Examiner*—Manish S. Shah
*Assistant Examiner*—Mark J Stevenosky, Jr.
(74) *Attorney, Agent, or Firm*—Robert J. Depke; Rockey, Depke & Lyons, LLC.

(57) ABSTRACT

A liquid ejection head including at least one head chip including a plurality of heating elements on a surface of a substrate, a nozzle sheet having nozzles disposed on the respective heating elements, a barrier layer disposed between the head chip and the nozzle sheet, reservoirs disposed between the heating elements and the nozzle sheet, the reservoirs being defined by part of the barrier layer, a common flow path communicating with the reservoirs, and a liquid storage chamber disposed on at least one region of the surface of the substrate excluding a region on which the reservoirs are disposed, the liquid storage chamber being defined by part of the barrier layer and communicating with the common flow path and the reservoirs, the liquid storage chamber storing liquid such that part of the nozzle sheet is in contact with the liquid.

23 Claims, 24 Drawing Sheets

U.S. PATENT DOCUMENTS

| | | | | |
|---|---|---|---|---|
| 6,485,128 | B1 * | 11/2002 | Elshaik et al. | 347/62 |
| 6,540,337 | B1 * | 4/2003 | Pollard | 347/65 |
| 6,561,632 | B2 * | 5/2003 | Feinn et al. | 347/65 |
| 6,834,944 | B2 * | 12/2004 | Wang et al. | 347/65 |
| 6,922,203 | B2 * | 7/2005 | Giere et al. | 346/65 |
| 2002/0101479 | A1 * | 8/2002 | Giere et al. | 347/54 |
| 2002/0163563 | A1 * | 11/2002 | Blair | 347/65 |
| 2003/0048333 | A1 * | 3/2003 | Rapp et al. | 347/65 |
| 2003/0058307 | A1 * | 3/2003 | Eguchi et al. | 347/62 |
| 2003/0137561 | A1 * | 7/2003 | Conta et al. | 347/61 |
| 2003/0156162 | A1 * | 8/2003 | Hirota et al. | 347/66 |
| 2004/0109044 | A1 * | 6/2004 | Conta et al. | 347/65 |
| 2005/0200662 | A1 * | 9/2005 | Eguchi et al. | 347/65 |

FOREIGN PATENT DOCUMENTS

| | | |
|---|---|---|
| JP | 59-138461 | 8/1984 |
| JP | 63-183855 | 7/1988 |
| JP | 09-011479 | 1/1997 |
| JP | 2003-080711 | 3/2003 |
| JP | 2003-136737 | 5/2003 |

* cited by examiner

FIG. 7

PRIOR ART

| SPECIFICATIONS | KNOWN HEAD | HEAD OF EXAMPLE |
|---|---|---|
| SIZE OF HEAD CHIP | 15.400x1.680x0.65[mm] | |
| PITCH OF NOZZLES 18 | 600 DPI (42.3[μm]) | |
| THE NUMBER OF NOZZLES FOR HEAD CHIP | 320 | |
| ARRANGEMENT OF NOZZLES 18 | 1/2-PITCH STAGGERED ARRANGEMENT | |
| DISTANCE FROM LINES OF NOZZLES 18 TO EDGE OF HEAD CHIP | 125±15[μm] | |
| THICKNESS AND MATERIAL OF NOZZLE SHEET 17 | 13[μm], NICKEL ELECTROFORMING | |
| WIDTH OF FLOW PATH (DISTANCE BETWEEN HEAD CHIPS) | 256±30[μm] | |
| THICKNESS OF BARRIER LAYERS 3 AND 13 | 11±1[μm] | |
| SHAPE OF BARRIER LAYERS 3 AND 13 | HEAD SHOWN IN FIG. 2A | HEAD SHOWN IN FIG. 5A |

FIG. 12

| KNOWN HEAD (SS1222) | | | | | | | | | | |
|---|---|---|---|---|---|---|---|---|---|---|
| TIME (sec) | 30 | 60 | 90 | 120 | 150 | 180 | 210 | 240 | 270 | 300 |
| a | 62.10 | 59.00 | 58.80 | 56.20 | 53.90 | 54.90 | 50.40 | 49.50 | 50.80 | 48.40 |
| b | 61.00 | 59.10 | 58.60 | 58.10 | 54.50 | 53.50 | 53.70 | 50.90 | 49.50 | 48.50 |
| c | 60.00 | 59.20 | 58.10 | 55.30 | 53.50 | 54.30 | 49.70 | 50.40 | 49.40 | 48.00 |
| d | 62.90 | 61.10 | 58.60 | 56.50 | 55.80 | 54.00 | 51.10 | 51.90 | 50.70 | 49.10 |
| AVERAGE OF A-D | 61.50 | 59.60 | 58.53 | 56.53 | 54.43 | 54.18 | 51.23 | 50.68 | 50.10 | 48.50 |
| e | 32.30 | 32.50 | 32.80 | 33.00 | 32.90 | 31.20 | 30.80 | 30.20 | 29.30 | 31.20 |

| HEAD OF EXAMPLE (SS1228) | | | | | | | | | | |
|---|---|---|---|---|---|---|---|---|---|---|
| TIME (sec) | 30 | 60 | 90 | 120 | 150 | 180 | 210 | 240 | 270 | 300 |
| a | 56.60 | 54.90 | 54.30 | 53.70 | 49.90 | 49.40 | 48.30 | 45.70 | 44.90 | 46.40 |
| b | 57.20 | 54.70 | 51.60 | 51.00 | 49.50 | 48.60 | 46.50 | 47.40 | 46.50 | 45.20 |
| c | 58.00 | 56.20 | 55.70 | 52.80 | 49.90 | 49.70 | 48.40 | 47.00 | 47.00 | 46.10 |
| d | 56.80 | 55.20 | 54.20 | 51.50 | 50.70 | 48.40 | 47.60 | 47.00 | 45.50 | 45.10 |
| AVERAGE OF A-D | 57.15 | 55.25 | 53.95 | 52.25 | 50.00 | 49.03 | 47.70 | 46.78 | 45.98 | 45.70 |
| e | 32.50 | 32.90 | 31.30 | 31.40 | 32.40 | 31.80 | 30.60 | 29.90 | 30.00 | 26.70 |

DUMMY CHIP D
P1:HEATER 12
R4:
BARRIER
LAYER 13
P3:
NOZZLE
SHEET 17
X
P2:HEAD CHIP 10a
650
1680
470
R7:ADHESIVE LAYER
5R:LIQUID (INK)
P4:CHANNEL PLATE 22

P1
R1
P2
R2
C1
R4
R5
C3
R7
P4
R9
C5
P3
R3
C2
R6
C4
R8
V1
E:AMBIENT TEMPERATURE (25°C)
P1:HEATER
P2:HEAD CHIP
P3:NOZZLE SHEET
P4:CHANNEL PLATE

FIG. 15

| Pn | POSITION | Cn | HEAT CAPACITY | Rn | THERMAL FLOW | GROUNDS FOR OMISSION IN SIMPLIFIED EQUIVALENT CIRCUIT | NOTE |
|---|---|---|---|---|---|---|---|
| P1 | SURFACE OF HEATER 12 | C1 | LIQUID ON SURFACE OF NOZZLE SHEET | R1 | ELEMENT-SEPARATING LAYER (SIN) | – | |
| P2 | SURFACE OF SEMICONDUCTOR SUBSTRATE 11 | C2 | NOZZLE SHEET 17 | R2 | INDIVIDUAL AND COMMON FLOW PATHS | – | DEPEND ON "X" |
| P3 | SURFACE OF NOZZLE SHEET 17 | C3 | LIQUID IN FLOW PATH | R3 | NOZZLE SHEET 17 | – | SPONTANEOUS DISSIPATION INTO AIR |
| P4 | SURFACE OF CHANNEL PLATE 22 | C4 | CHANNEL PLATE 22 | R4 | BARRIER LAYER 13 | R4>>R2 | |
| | | C5 | SEMICONDUCTOR SUBSTRATE 11 | R5 | LIQUID IN FLOW PATH | R5>>R2 | R5/R8≒ 8(KNOWN HEAD) |
| | | | | R6 | SUPPLIED LIQUID | R6>>R5 | |
| | | | | R7 | ADHESIVE LAYER | R7>>R5 | |
| | | | | R8 | DISSIPATION ON CHANNEL PLATE 22 | R8>>R6 | SPONTANEOUS DISSIPATION INTO AIR |
| | | | | R9 | DISSIPATION ON EDGE OF HEAD CHIP 10a | R9>>R3 | SPONTANEOUS DISSIPATION INTO AIR |

PRIOR ART

PRIOR ART

PRIOR ART

PRIOR ART

REGION OF REDUCED INK SUPPLY DUE TO DEVELOPMENT OF BUBBLES (WIDTH: approx. 4 NOZZLES)

LIQUID EJECTION HEAD AND LIQUID EJECTION APPARATUS

The present application claims priority to Japanese Patent Application JP2004-014183, filed in the Japanese Patent Office on Jan. 22, 2004; the entire content of which is incorporated herein by reference.

BACKGROUND OF THE INVENTION

1. Field of the Invention

The present invention relates to thermal liquid ejection heads for inkjet printers and liquid ejection apparatuses such as inkjet printers including the liquid ejection heads, and more particularly, to a technique for cooling a liquid ejection head, that is, a technique that can reduce thermal variation of the liquid ejection head per unit time.

2. Description of the Related Art

Thermal liquid ejection heads and piezoelectric liquid ejection heads are well known examples of liquid ejection heads used in liquid ejection apparatuses such as inkjet printers. The former utilizes expansion and contraction of bubbles generated by heat, whereas the latter utilizes the variation in shape and volume of piezoelectric elements. The thermal liquid ejection heads include heating elements on semiconductor substrates. When the heating elements heat up, generated heat vaporizes liquid in reservoirs to create bubbles, thereby ejecting liquid drops from nozzles, which are disposed above the heating elements, onto recording media.

FIG. 17 is a perspective view of a liquid ejection head or head 1 of a known type. Although a nozzle sheet 17 is bonded to a barrier layer 3 in an actual configuration, the nozzle sheet 17 is separated from the barrier layer 3 in FIG. 17 and the nozzle sheet 17 and the barrier layer 3 are inverted for convenience. FIG. 18 shows the structure of a flow path of the head 1 shown in FIG. 17.

Referring to FIGS. 17 and 18, a plurality of heating elements 12 is disposed on a semiconductor substrate 11. The barrier layer 3 and the nozzle sheet 17 are disposed on the semiconductor substrate 11 in this order. A head chip la includes the semiconductor substrate 11, provided with the heating elements 12, and the barrier layer 3 disposed on the semiconductor substrate 11. The head 1 includes the head chips 1*a* and the nozzle sheet 17 bonded onto the head chip 1*a*.

The nozzle sheet 17 includes nozzles 18 disposed right above the respective heating elements 12. The nozzles 18 have openings from which ink drops are ejected. Since the barrier layer 3 is disposed between the heating elements 12 and the nozzles 18, reservoirs 3*a* are formed in the spaces enclosed by the barrier layer 3, the heating elements 12, and the nozzles 18.

As shown in FIG. 17, the barrier layer 3 has a comb-shape when viewed from above. Therefore, three sides of each heating element 12 are enclosed by the barrier layer 3 but one side thereof is open such that this opening serves as an individual flow path 3*d*, which is connected to a common flow path 23.

The heating elements 12 are aligned in the vicinity of one side of the semiconductor substrate 11. As shown in FIG. 18, since a dummy chip D is disposed on the left side of the semiconductor substrate 11 (head chip 1*a*), the common flow path 23 is formed between the left side of the semiconductor substrate 11 (head chip 1*a*) and the right side of the dummy chip D. The dummy chip D may be composed of any component that can form the common flow path 23 with the semiconductor substrate 11.

As shown in FIG. 18, a channel plate 22 is disposed on the side of the semiconductor substrate 11 opposite from the side on which the heating elements 12 are disposed. The channel plate 22 includes an inlet 22*a* and a supplying flow path 24 communicating with the inlet 22*a*. The supplying flow path 24 having a rectangular cross section, in turn, communicates with the common flow path 23.

Ink supplied from the inlet 22*a* passes through the supplying flow path 24, the common flow path 23, and the individual flow path 3*d* to enter the reservoir 3*a*. When the heating element 12 heats up, a bubble is generated in the reservoir 3*a* on the heating element 12. The generated bubble ejects a drop of ink in the reservoir 3*a* through the nozzle 18.

In FIGS. 17 and 18, dimensions are not to scale and some parts are enlarged to aid understanding. In actual size, the thickness T of the semiconductor substrate 11 shown in FIG. 19 is about 600 to 650 μm, and the thicknesses of the nozzle sheet 17 and the barrier layer 3 are about 10 to 20 μm, for example.

FIG. 19 shows a state in which a droplet is ejected due to the heat by the heating elements 12 disposed in the head chip 1*a* shown in FIG. 18. Typically, a distance Yn from the center of the heating element 12 to a first side surface of the head chip 1*a* that faces the dummy chip D is about 100 to 200 μm, whereas the width of the head chip 1*a* is about ten times larger than the distance Yn, namely, larger by an order of magnitude. That is, the heating elements 12 are disposed close to the first side surface of the head chip 1*a*.

In the structure shown in FIGS. 18 and 19, when the heating elements 12 heat up to high temperatures, the temperatures of the heating elements 12 can be hundreds of degrees Celsius at a moment. This generated heat brings liquid on the heating elements 12 to a boil. At this time, the heat also travels through the semiconductor substrate 11 on which the heating elements 12 are disposed. To minimize this energy loss, a heat-insulation layer composed of a material having a low thermal conductivity such as silicon oxide is disposed between the heating elements 12 and the semiconductor substrate 11.

It is the top surface of the semiconductor substrate 11 that the heat traveling through the semiconductor substrate 11 reaches first. The top surface of the semiconductor substrate 11 is flash with the top surface of the heating elements 12 and is in contact with liquid. Secondly, the heat traveling through the semiconductor substrate 11 reaches the first side surface of the semiconductor substrate 11, that is, the surface forming the common flow path 23 with the dummy chip D.

Now, a mechanism of how a bubble is generated in a thermal liquid ejection head will be described. A heater, e.g., the heating element 12 is in contact with liquid such as ink, and thermal energy from the heater heats up the liquid. When the temperature of the heater exceeds the boiling point of the liquid, the liquid boils. From an academic point of view, "boiling" denotes nucleate boiling. More specifically, the surface of the heater has small scratches or dents in which masses of air, which are called bubble nuclei, exist. Bubbles are generated in these bubble nuclei.

Accordingly, even though the heaters are in contact with liquid, generation of bubbles depends on the condition of the surfaces of the heaters at the same temperature. The number of bubble nuclei determines the number of bubbles generated on the surface of the heater. More bubbles are generated on the surface of the heater with many bubble nuclei than on the surface of the heater with a small number of bubble nuclei. That is, bubbles are readily generated on a rough surface but are hardly any generated on a smooth surface.

The surface of the head chip 1*a* on which the heating elements 12 are disposed is very precisely finished by a semiconductor process and thus is extremely smooth. By contrast, since the first side surface of the head chip 1*a* is processed through dicing, that is, cutting using, e.g., a rotary saw, the first side surface of the head chip 1*a* has irregularities and thus bubble nuclei exist therein. FIG. 20 is an enlarged photomicrograph showing the surface of the head 1 and a surface cut through dicing. Hence, bubbles are readily generated in liquid on the first side surface of the head chip 1*a*.

To prevent bubbles from being generated on the first side surface of the head chip 1*a*, the following methods are proposed. A first method is that the heating elements 12 are aligned well remote from the first side surface of the head chip 1*a* such that it is difficult for the heat generated by the heating elements 12 to reach the first side surface. In this way, thermal energy reaching the first side surface of the head chip 1*a* hardly brings liquid to a boil.

A second method is that the first side surface of the head chip 1*a* is made smooth such that irregularities in which bubble nuclei exist are eliminated. A third method, which is disclosed in Japanese Unexamined Patent Application Publication No. Hei 9-11479, is that an ink inlet or opening is formed through anisotropic etching in the center area of the head chip 1*a* and a heating element is disposed in the vicinity of the ink inlet.

With the first method, since a wide gap is disposed between the first side surface of the head chip 1*a* and the aligned heating elements 12, the gap makes the head 1 large, which contradicts high-density packaging of the head chip 1*a*. The second method requires an additional step of processing the surface of the head chip 1*a* after the head chip 1*a* is cut through dicing, resulting in increased cost.

With the third method, anisotropic etching is performed on the head chip 1*a* and thus the surface on which the ink inlet is formed is extremely smooth. Therefore, bubbles do not develop on this smooth surface of the head chip 1*a*. Unfortunately, since the ink inlet is provided in the center area of the head chip 1*a*, the head chip 1*a* has a complex structure. Thus, provision of the ink inlet is not suitable for the structure of the head chip 1*a* including the heating elements 12 aligned close to the first side surface of the semiconductor substrate 11.

The influences of development of bubbles on the first side surface of the head chip 1*a* will now be described. FIG. 21 is a cross-sectional view of the head chip 1*a* shown in FIG. 18 showing the state where bubbles are generated. FIG. 21 shows the head chip 1*a* when it is actually used and so the elements shown in FIG. 18 are inverted in FIG. 21. As described above, in the semiconductor substrate 11, bubbles are generated the most at a portion whose temperature is highest in the region where bubbles are generated (bubbling region) shown in FIG. 21. This portion is in contact with ink and bubble nuclei exist therein. This portion is the lowermost part in the bubbling region in FIG. 21.

Theoretically, bubbles generated in ink move upward by its buoyancy. In actual use, however, ejection of ink drops reduces the amount of ink in the reservoir 3*a*. Accordingly, ink in the bubbling region is drawn towards the nozzle 18, that is, towards the reservoir 3*a*, and the bubbles are also drawn towards the common flow path 23 and the individual flow path 3*d*.

FIG. 22 is an enlarged photograph of the head 1 including the transparent nozzle sheet having the same structure as that of the nozzle sheet 17. The photograph in FIG. 22 is taken immediately after liquid drops are ejected and shows the generation of bubbles. White dots in FIG. 22 are bubbles, whereas black dots are spatters of ejected ink drops.

Even when the number of bubbles generated in the individual flow paths 3*d* and the common flow path 23 close to the individual flow paths 3*d* is very small, ejection of ink may be influenced by these bubbles to some extent. When the number of generated bubbles is large, small bubbles may be united into larger bubbles. In this case, the surface tension of the bubbles decreases the amount of ink supplied to narrow flow paths, that is, the individual flow paths 3*d*. Moreover, ink cannot flow into the individual flow paths 3*d* at all in some cases. FIG. 23 is an enlarged photograph of the head 1, showing the region where ink supply is decreased because some small bubbles are united into larger bubbles.

Due to a decrease in the amount of ink supplied to the individual flow path 3*d*, a sufficient amount of ink cannot be ejected as ink drops. Moreover, sometimes no ink is ejected from a nozzle at all. A serial head for a serial printer prints an image or character by multiple ink ejection by being slightly moved while printing and thus the amount of ejected ink can be evened out over the print sheet. Thus, failure in ink ejection is not noticeable. On the other hand, a line head for a line printer prints an image or character by a single ink ejection. Therefore, when the line head encounters failure in ink ejection, the resulting printing has a line (white line) at a position corresponding to the part of the head suffering from the failure.

FIG. 24 is an enlarged photograph of a line head, showing a white line formed due to lack of ink supply to the reservoirs 3*a*, which is caused by the generation of bubbles. In FIG. 24, ejection failure occurs in the width for about four nozzles out of the entire width of about 2.7 mm for 64 nozzles.

SUMMARY OF THE INVENTION

It is an object of the present invention to minimize the distance Yn in FIG. 19 and the generation of bubbles in areas other than those on heating elements, thereby suppressing the occurrence of a white line due to development of bubbles in undesired areas.

According to a liquid ejection head of the present invention includes: a substrate; at least one head chip including a plurality of heating elements on a surface of the substrate; a nozzle layer having nozzles disposed above the respective heating elements; a barrier layer disposed between the head chip and the nozzle layer; reservoirs disposed between the heating elements and the nozzles, the reservoirs being defined by part of the barrier layer; a common flow path communicating with the reservoirs, the common flow path supplying liquid to the reservoirs; and a liquid storage chamber disposed on at least one region of the surface of the substrate excluding a region on which the reservoirs are disposed, the liquid storage chamber being defined by part of the barrier layer, the liquid storage chamber communicating with the common flow path and the reservoirs, the liquid storage chamber storing liquid such that part of the nozzle layer is in contact with the liquid. In the liquid ejection head, heating energy is applied to the heating elements to generate bubbles on the heating elements, and the generated bubbles expel liquid in the reservoirs to be ejected through the nozzles.

According to the liquid ejection head and the liquid ejection apparatus of the invention, when liquid is supplied to the liquid ejection head, not only reservoirs but also the liquid storage chamber is filled with liquid. Liquid in the liquid storage chamber is in contact with the nozzle layer. Thus, heat generated by the heating elements in the head chip is transmitted to the nozzle layer by way of the liquid in the liquid storage chamber.

In the liquid ejection head and the liquid ejection apparatus of the present invention, the operational temperature of the head chip is lower than that of the known head. Accordingly, nucleate boiling hardly occurs, that is, bubbles are hardly any generated, thereby suppressing temperature increase. Furthermore, the frequency for ink ejection is increased and thus the ejection/refill cycle is accelerated, thereby realizing high-speed printing.

When the liquid ejection head constitutes the line head, the temperatures of all head chips in the line head are approximately the same. Accordingly, variation in amount of ejected liquid due to temperature change is reduced, thereby suppressing unevenness of ink density in printing.

BRIEF DESCRIPTION OF THE DRAWINGS

FIG. 7 summarizes the specifications of the known head and the heads of Examples 1 and 2 according to the present invention;

FIG. 12 shows tables containing measured temperatures;

FIG. 15 is a table containing elements of the equivalent circuit;

DESCRIPTION OF THE PREFERRED EMBODIMENTS

Embodiments according to the present invention will now be described by referring to the accompanying drawings.

First Embodiment

Figure 1:
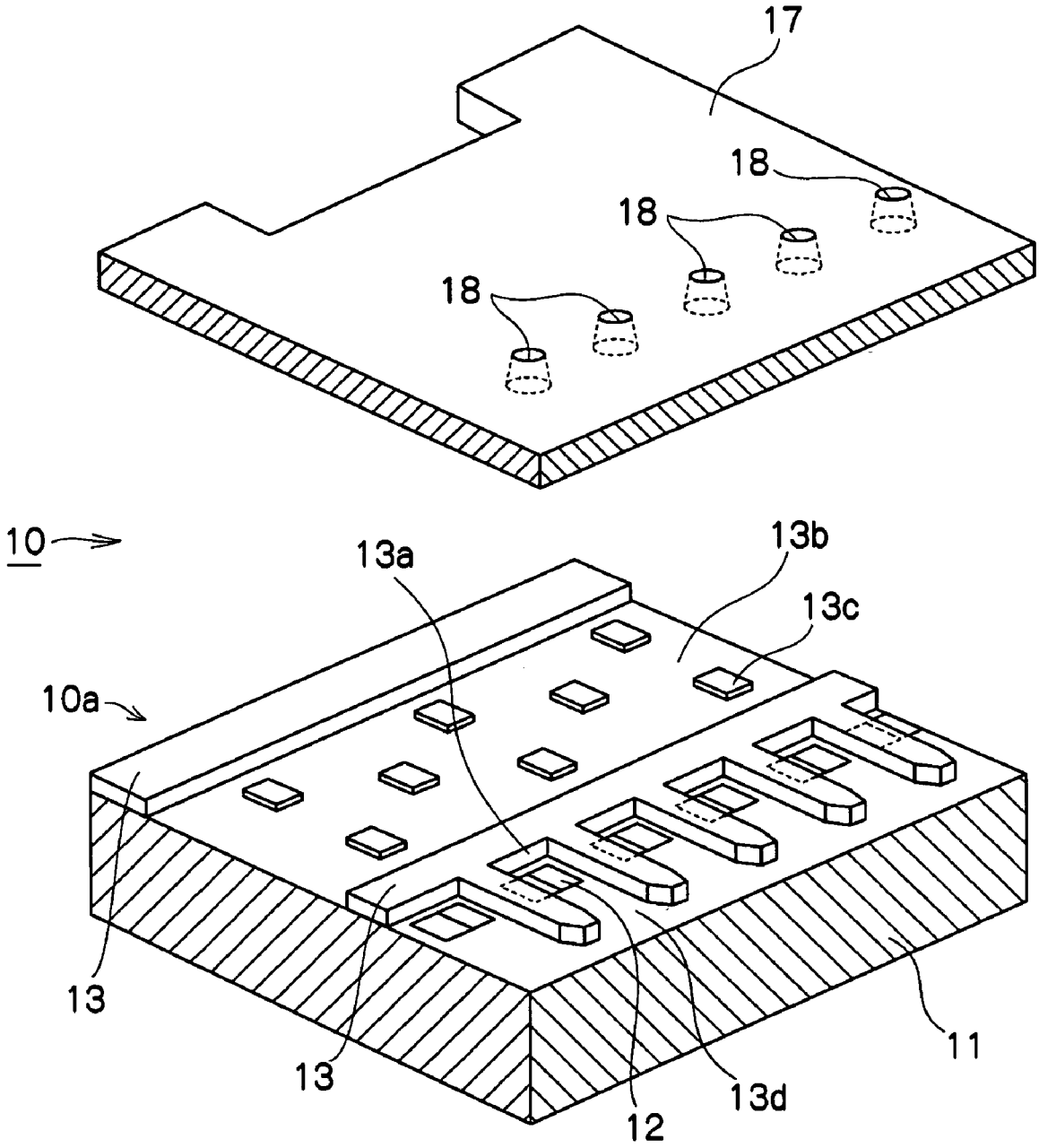
FIG. 1 is an exploded perspective view of a liquid ejection head according to a first embodiment, which is mounted in a liquid ejection apparatus of the present invention.
Figure 17:
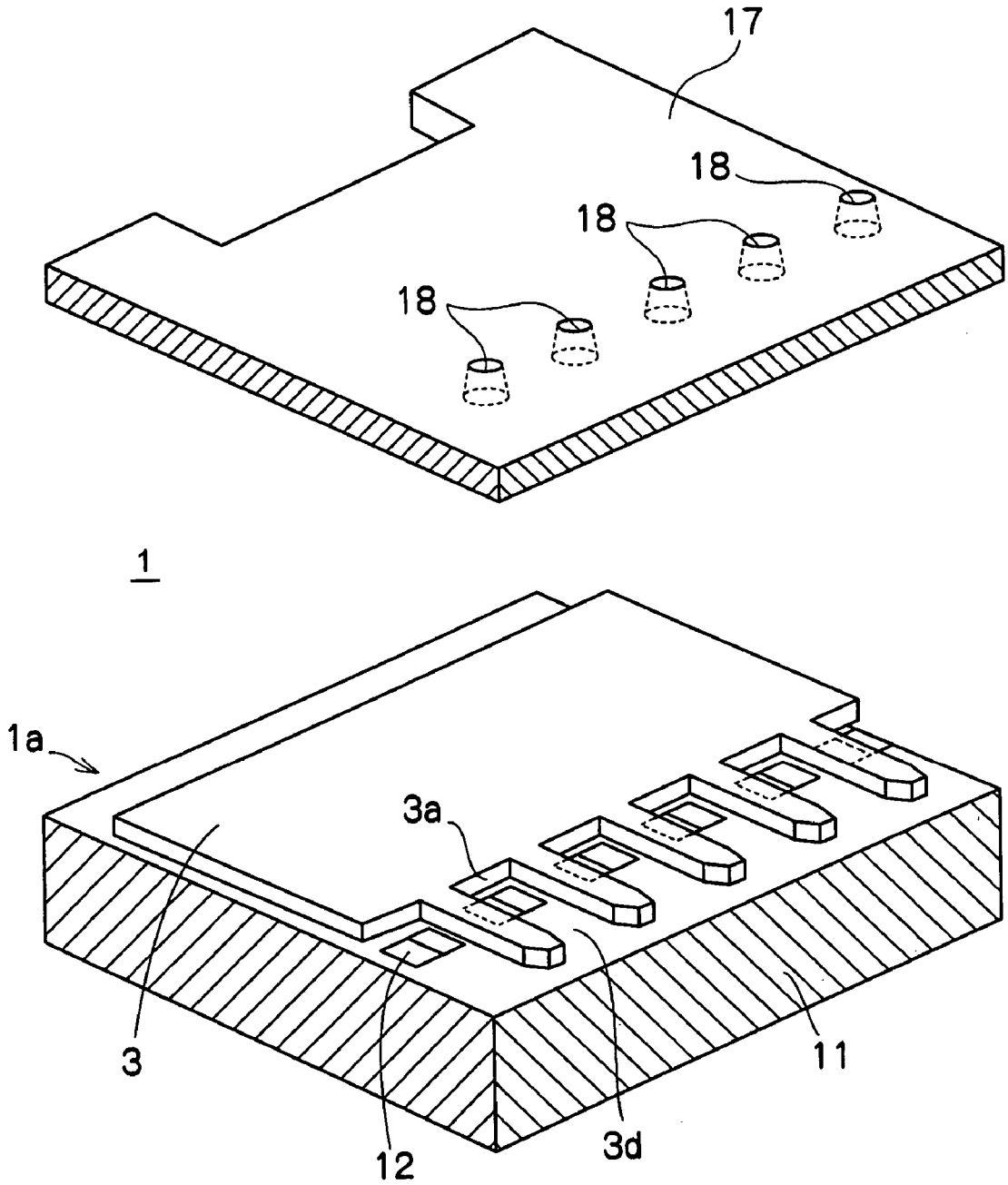
FIG. 17 is a perspective view of the known liquid ejection head.
Figure 18:
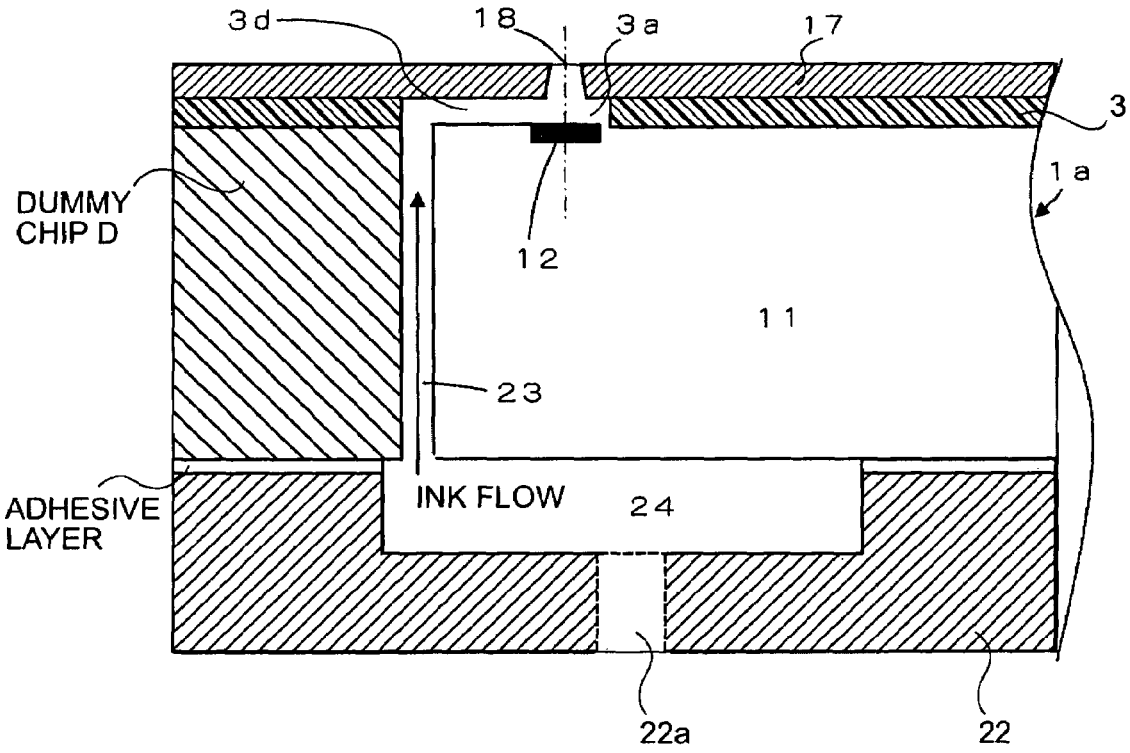
FIG. 18 is a cross-sectional view of the known head, showing the structure of a flow path.
Figure 19:
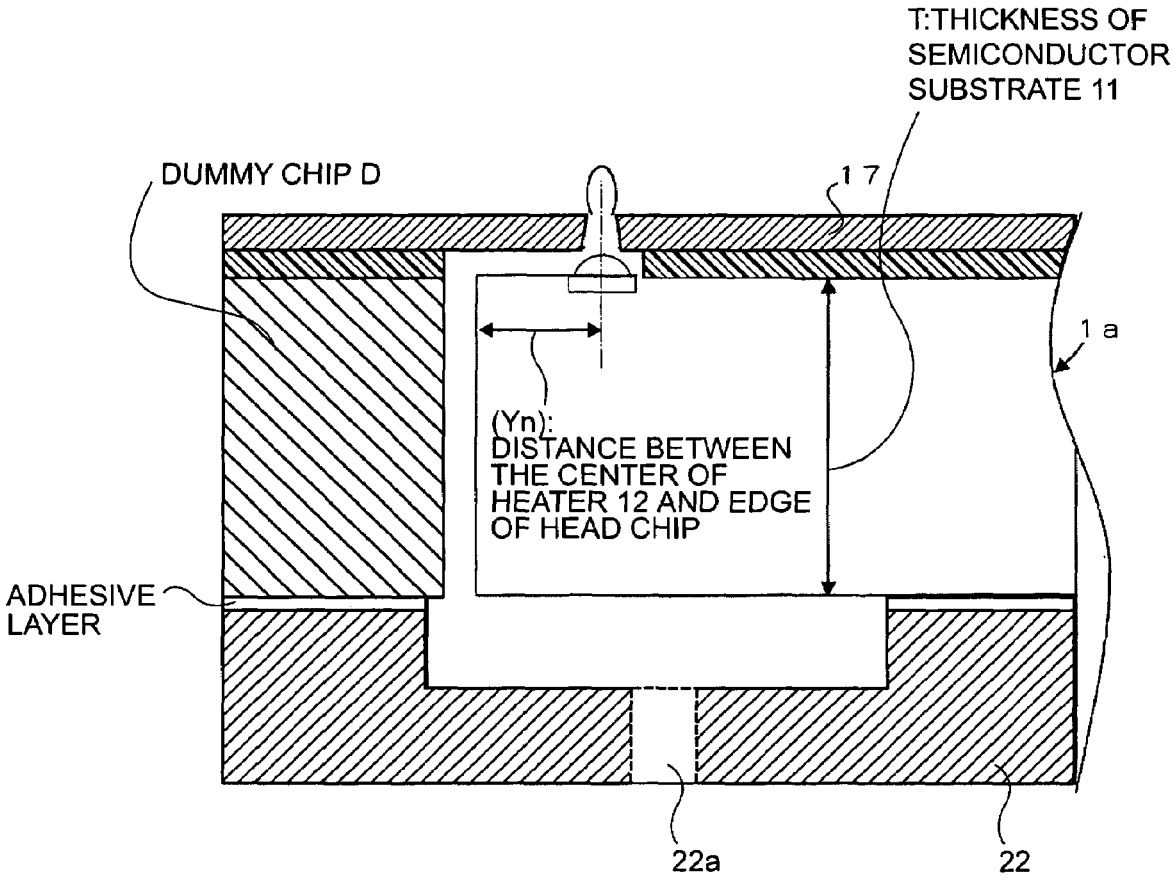
FIG. 19 is a cross-sectional view of the known head, showing a state where heat is generated in a heating element to eject an ink drop.
Figure 20:
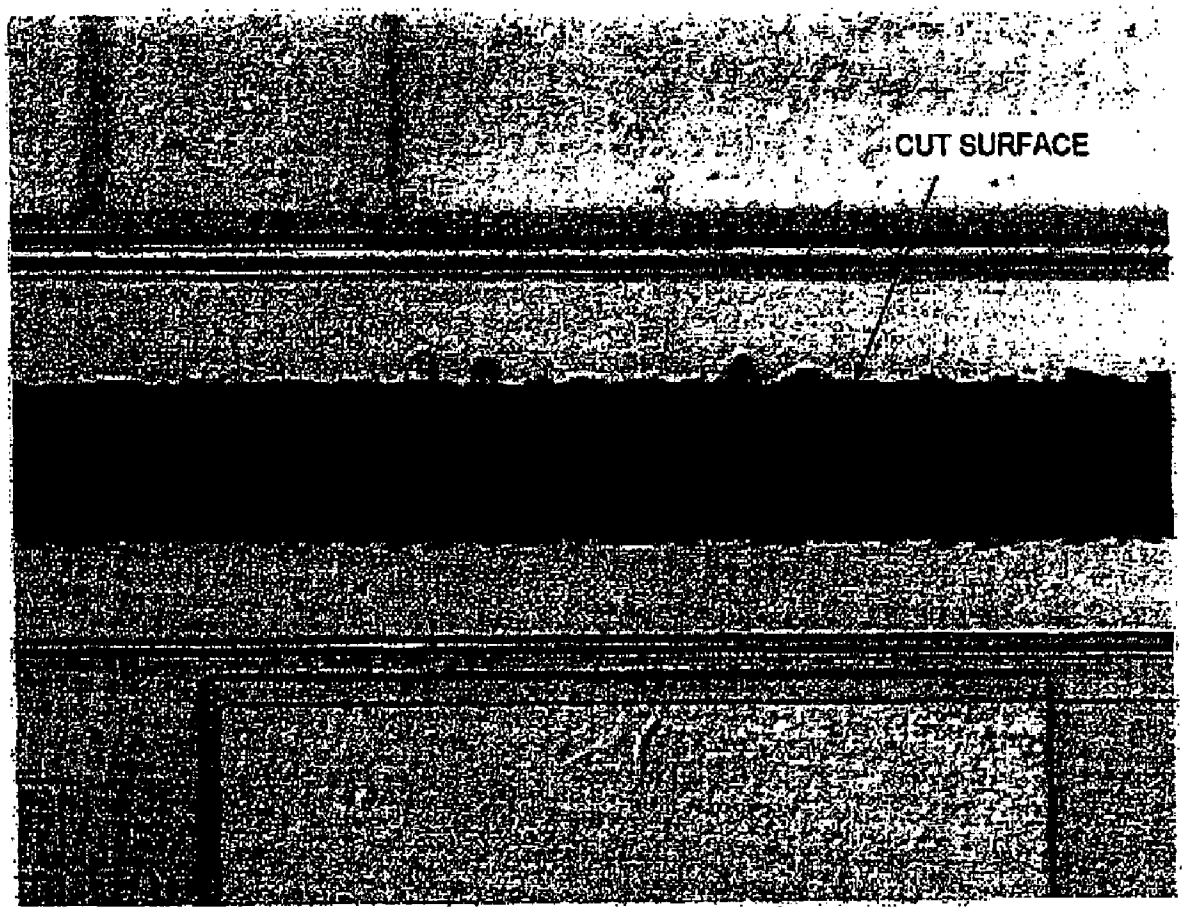
PRIOR ART FIG. 20
FIG. 20 is an enlarged photomicrograph showing the surface of a head chip and a surface cut through dicing.
Figure 21:
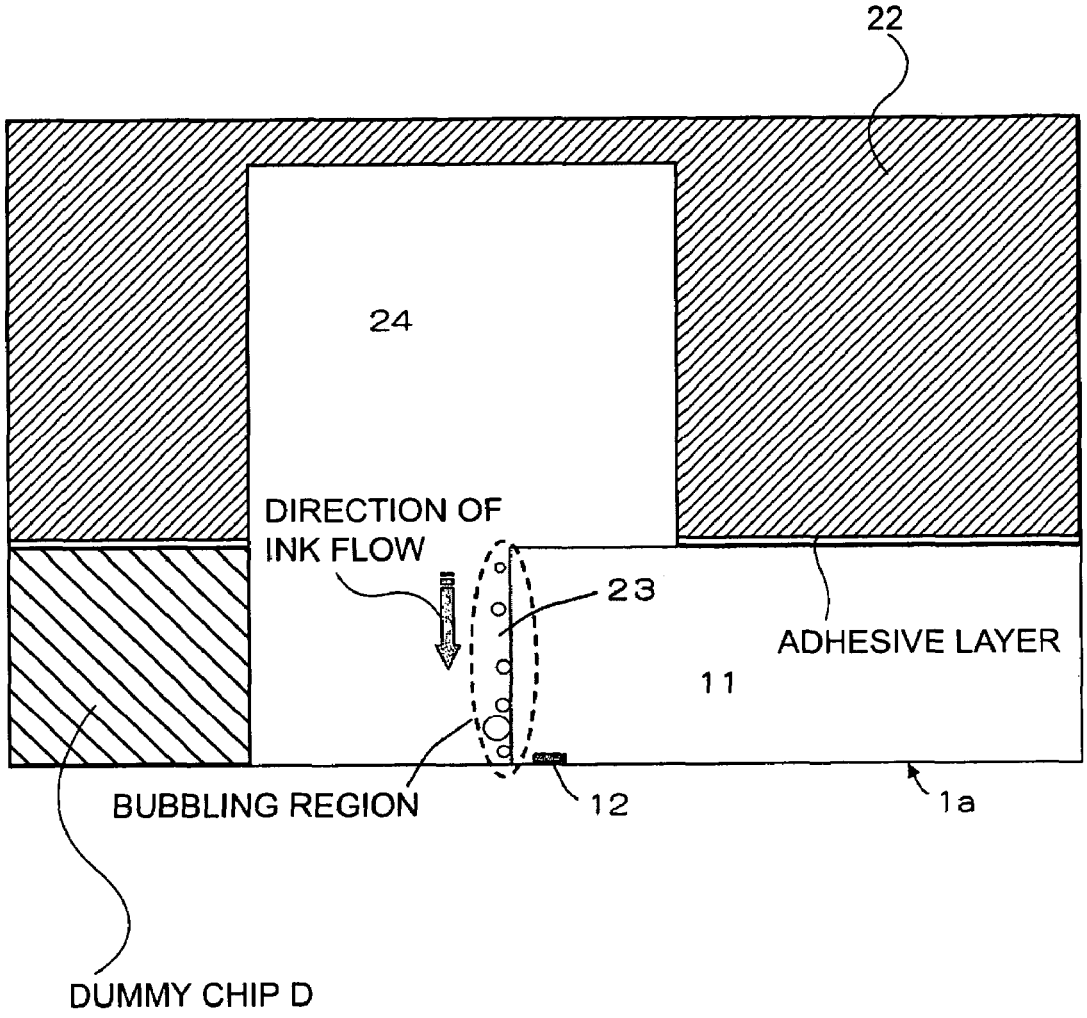
FIG. 21 is a cross-sectional view of the head chip shown in FIG. 18, showing the state where bubbles are generated.

FIG. 1 is an exploded perspective view of a liquid ejection head or head 10 according to a first embodiment of the present invention. The head 10 is to be mounted in a liquid ejection apparatus of the present invention. FIG. 1 corresponds to FIG. 17 showing the head of a known type. Although a nozzle sheet or nozzle layer 17 is bonded to a barrier layer 13 in the actual head 10, the nozzle sheet 17 is separated from the barrier layer 13 in FIG. 1. A head chip 10*a* includes a semiconductor substrate 11 having heating elements 12 thereon and a barrier layer 13 disposed on the semiconductor substrate 11. The head 10 includes the head chip 10*a* onto which the nozzle sheet 17 is bonded.

Figure 2C:
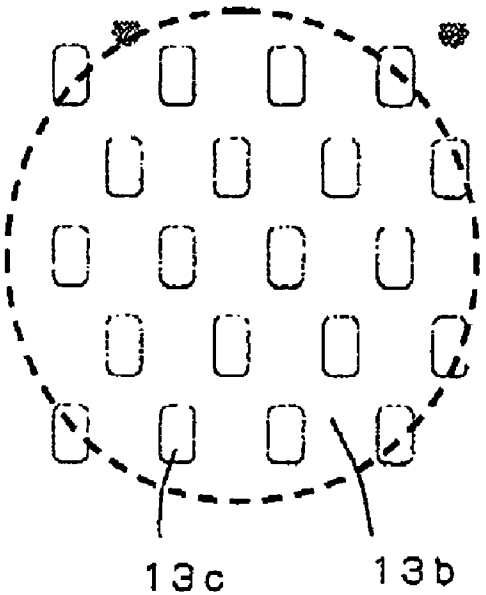
FIG. 2C is a detailed view of the circled portion in FIG. 2B.
Figure 2A:
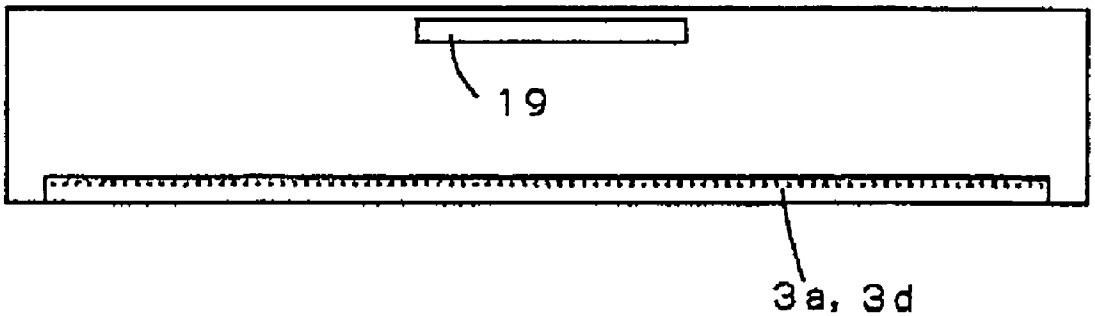
FIG. 2A PRIOR ART
FIG. 2A is a plan view of a head chip of a known type.
Figure 2B:
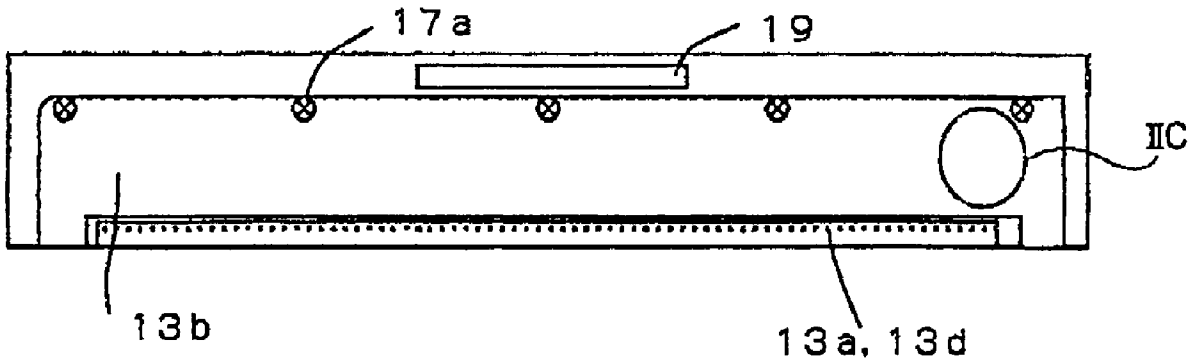
FIG. 2B is a plan view of a head chip of the first embodiment.

FIG. 2A is a plan view of the head chip 1*a* of a known type. FIG. 2B is a plan view of the head chip 10*a* of the first embodiment. FIG. 2C is a detailed view of the circled portion in FIG. 2B. In FIGS. 2A, 2B, and 2C, the nozzle sheet 17 is not illustrated and the FIG. 2B includes exhaust holes 17*a*.

Referring to FIG. 17, the semiconductor substrate 11 and the heating elements 12 of the first embodiment have the same structures as those of the semiconductor substrate 11 and the heating elements 12 of a known type shown in FIG. 17. A barrier 13 is disposed on the semiconductor substrate 11 of the first embodiment. Reservoirs 13*a* and individual flow paths 13*d* are defined by the barrier layer 13. The reservoirs 13*a* are disposed on the respective heating elements 12.

According to the head chip 1*a* of a known type, the barrier layer 3 accounts for most of the top surface of the semiconductor substrate 11 except the regions where the reservoirs 3*a*, the individual flow paths 3*d*, and a connecting electrode region (not shown) are disposed. That is, the reservoirs 3*a* and the individual flow paths 3*d* account for only about less than 10% of the top surface of the semiconductor substrate 11 in the head chip 1*a* of a known type.

By contrast, according to the head chip 10*a* of the first embodiment, the barrier layer 13 has a portion having a comb-shape (comb-shaped portion). The reservoirs 13*a* and the individual flow paths 3*d* are disposed in the spaces defined by the comb-shaped portion. An area connected to the comb-shaped portion is a liquid storage chamber 13*b* including a great number of columns 13*c*. These columns 13*c* connect the barrier layer 13 to the nozzle sheet 17 when the barrier layer 13 is bonded to the nozzle sheet 17. Since all the columns 13*c* have the same height, the heights of all the reservoirs 13*a* are identical.

The heights of the columns 13*c* are the same as the height of the comb-shaped portion defining the reservoirs 13*a* and the individual flow paths 13*d*. Each column 13*c* is substantially rectangular in plan view, for example, measuring 20 μm×30 μm. The columns 13*c* can be disposed in any arrangement at any pitch.

The barrier layer 13 has three walls on the semiconductor substrate 11. These walls are disposed in the three sides of the semiconductor substrate 11 except the side where the comb-shaped portion is disposed. A connecting-electrode region 19 is disposed on one of the walls. The liquid storage chamber 13*b* is enclosed by the walls and the comb-shaped portion of the barrier layer 13.

The liquid storage chamber 13*b* has openings on the side close to a common flow path so as to communicate with the common flow path. The common flow path of the first embodiment is identical to the common flow path 23 of the head chip 1*a* of a known type and supplies liquid to the reservoirs 13*a*. The openings in the liquid storage chamber 13*b* are disposed in the right front side in FIG. 1 and at the bottom edges of the head chip 10*a* in FIG. 2B. Since the openings are connected to the common flow path, the liquid storage chamber 13*b* is connected to the reservoirs 13*a* through the common flow path and the individual flow paths 13*d*.

Referring to FIG. 2B, exhaust holes 17*a* pass through the nozzle sheet 17 and are disposed in the area under which the liquid storage chamber 13*b* is disposed. Five exhaust holes 17*a* are illustrated in FIG. 2B. The exhaust holes 17*a* are disposed remote from the reservoirs 13*a* and the individual flow paths 13*d*.

As described above, the comb-shaped portion of the barrier layer 13 defines the reservoirs 13*a* and the individual flow paths 13*d*. The reservoirs 13*a* are disposed between the heating elements 12 and the respective nozzles 18. The individual flow paths 13*d* communicate with the reservoirs 13*a* and supply liquid to the reservoirs 13*a*. The liquid storage chamber 13*b* for storing liquid is disposed on the area of the surface of the semiconductor substrate 11 except the regions including the reservoirs 13*a* and the individual flow paths 13*d*. The liquid storage chamber 13*b* is defined by part of the barrier layer 13. The liquid storage chamber 13*b* communicates with the reservoirs 13*a*.

Ink supplied from, e.g., an ink tank first flows into the common flow path and then passes through the individual flow paths 13*d* to fill the reservoirs 13*a*. Concurrently, ink from the common flow path enters the liquid storage chamber 13*b* communicating with the common flow path to fill the liquid storage chamber 13*b*.

Prior to the entrance of ink, the liquid storage chamber 13*b* is filled with air. Therefore, when ink enters the liquid storage chamber 13*b*, air in the liquid storage chamber 13*b* is discharged outside through the exhaust holes 17*a*. Accordingly, the liquid storage chamber 13*b* is filled with ink, containing no air.

When the liquid storage chamber 13*b* is filled with ink, ink comes in contact with the exits of the exhaust holes 17*a*, that is, the surface of the nozzle sheet 17. If the exhaust holes 17*a* have the same areas as those of the nozzles 18, surface tension on the orifice planes in the exhaust holes 17*a* and the nozzles 18 is identical. Thus, the nozzles 18 and the exhaust holes 17*a*, which are only exits for ink, are influenced by the pressure applied to ink. However, according to the first embodiment, since the areas of the exhaust holes 17*a* are smaller than those of the nozzles 18, ink does not leak through the exhaust holes 17*a* when pressure is applied to ink.

Therefore, even though environments of the head chip 10*a* change such as during transport, the exhaust holes 17*a* do not require special care but can be treated as part of the nozzles 18.

When the head 10 is operated, that is, ink supplied to the reservoirs 13*a* is ejected as droplets, ink from the common flow path passes through the individual flow paths 13*d* to fill the reservoirs 13*a*. At this time, hardly any ink moves in the liquid storage chamber 13*b*.

The bottom surface of the nozzle sheet 17 is bonded to the top surfaces of the columns 13*c*. Ink in the liquid storage chamber 13*b* is in contact with the bottom surface of the nozzle sheet 17 except the portions bonded to the top surfaces of the columns 13*c*.

According to the head chip 1*a* of a known type, most of heat generated by the heating elements 12 is transmitted to the nozzle sheet 17 through the barrier layer 3. Since the barrier layer 3 is composed of a photosensitive resist rubber or a dry film resist to be hardened by exposure and thus has low thermal conductivity, the barrier layer 3 does not well transmit the heat generated by the heating elements 12. Accordingly, heat generated by the heating elements 12 is not sufficiently dissipated from the nozzle sheet 17.

By contrast, according to the head 10 of the first embodiment, heat generated by the heating elements 12 is transmitted to ink in the liquid storage chamber 13*b*. Since ink in the liquid storage chamber 13*b* is in contact with the bottom surface of the nozzle sheet 17, heat generated by the heating elements 12 is readily transmitted to the nozzle sheet 17 through the ink in the liquid storage chamber 13*b*. Accordingly, the heat can be dissipated from the top surface of the nozzle sheet 17, whereby heat is well dissipated in the head chip 10*a*.

In this context, the liquid storage chamber 13*b* can also be referred to as a heat-storage liquid layer/chamber or thermal condenser layer/chamber. The heat capacity in the head chip 10*a* of the first embodiment is constant. Accordingly, as the amount of heat dissipation is increased in the head chip 10*a*, the temperature of the head chip 10*a* is decreased.

Figure 3A:
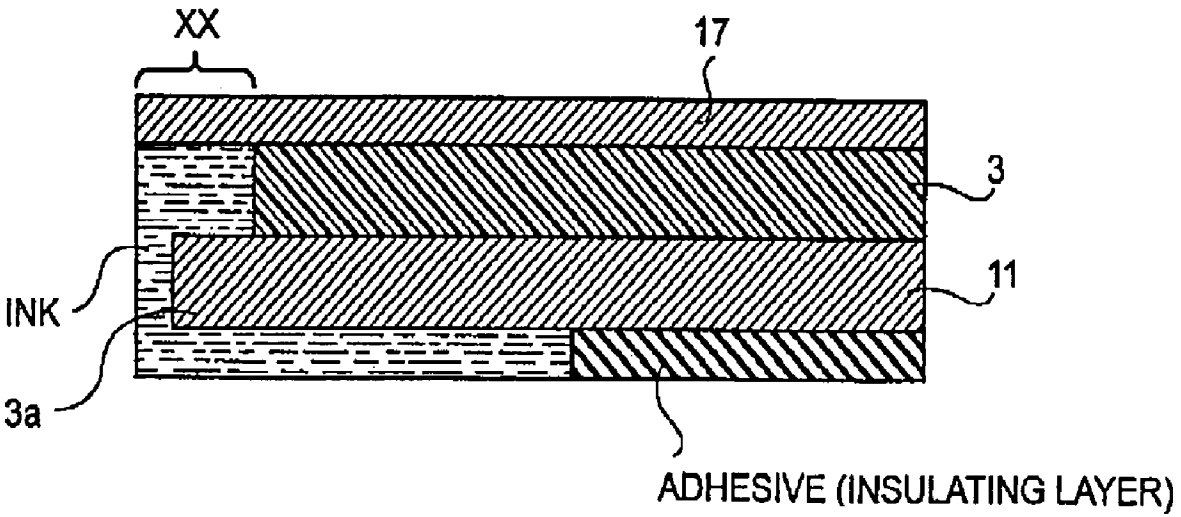
FIG. 3A (PRIOR ART)
FIG. 3A is a cross-sectional view of the known head, showing the state of heat dissipation.
Figure 3B:
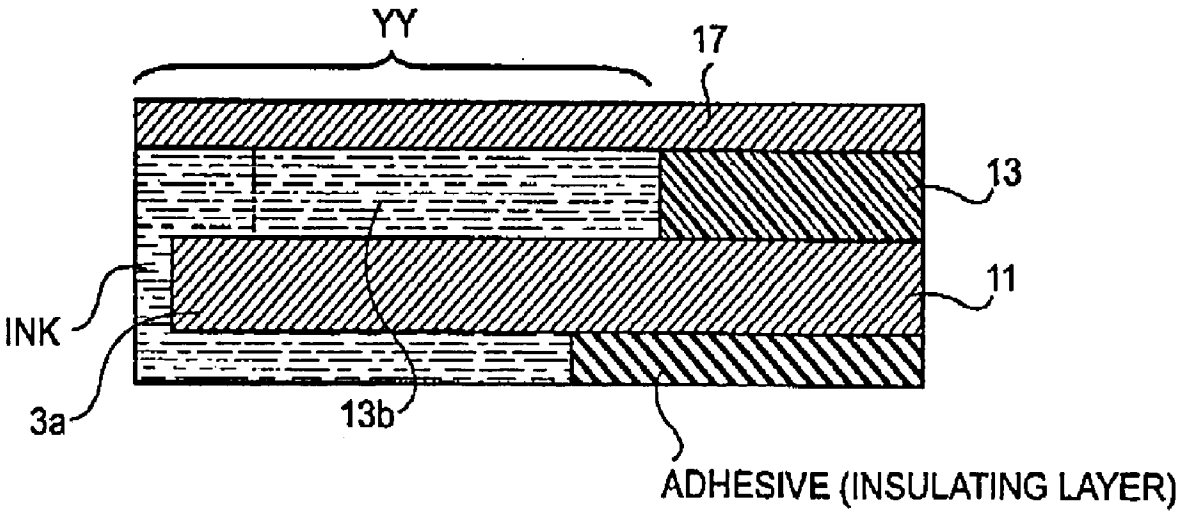
FIG. 3B is a cross-sectional view of the head of the first embodiment, showing the state of heat dissipation.

FIG. 3A is a cross-sectional view of the head 1, whereas FIG. 3B is a cross-sectional view of the head 10. These drawings show comparison of heat dissipation of the heads 1 and 10. In the drawings, the heating elements 12 are disposed on the left sides of the semiconductor substrates 11. The nozzle sheets 17 including nozzles 18 are disposed above the semiconductor substrates 11. In FIG. 3A and 3B, the heating elements 12 and the nozzles 18 are not illustrated.

According to the head 1 of a known type, heat generated by the heating element 12 is transmitted through a region including an area above the reservoir 3*a* and an area disposed on the left side of the area above the reservoir 3*a*. This region is designated by XX in FIG. 3A. By contrast, according to the head 10 of the first embodiment, heat generated by the heating elements 12 is transmitted to the nozzle sheet 17 through not only a region including an area above the reservoir 3*a* and an area disposed on the left side of the area above the reservoir 3*a*, which corresponds to the region designated by XX in FIG. 3A, but also through the liquid storage chamber 13*b*. The region transmitting the heat to the nozzle sheet 17 in the head 10 is designated by YY in FIG. 3B.

More specifically, according to the first embodiment, ink having a large specific heat capacity is disposed between the head chip 10*a* including the heating elements 12 and the nozzle sheet 17. The temperature of the head chip 10*a* does not increase sharply. Moreover, ink having higher thermal conductivity than the barrier layer 13 can transmit heat to the nozzle sheet 17. Therefore, heat is immediately transmitted to the nozzle sheet 17, and the heat radiates from the nozzle sheet 17 to cool down the head 10.

The nozzle sheet 17 can be composed of various kinds of materials. When the nozzle sheet 17 is composed of metal or a material chiefly made of metal, heat is effectively dissipated. Furthermore, the head 10 may include a plurality of the head chips 10*a*. For example, the head 10 is used as a color printer head including the head chips 10*a* for respective colors, or as a line head for a line printer including a plurality of the head chips 10*a* disposed along the common flow path. In this structure also, the head 10 is preferably provided with a single nozzle sheet 17 including the nozzles 18 for all the head chips 10*a*. In this way, the temperature of the head 10 is maintained constant at all times.

When the head chips 10*a* are used in the line head, an amount of ejected ink-drops, namely, the amount how much the head chip 10*a* is operated differs depending on the head chips 10*a*. Therefore, some head chips 10*a* radiate a lot of heat, while some radiate hardly any heat. Since the semiconductor substrate 11 in the head chips 10*a* composed of, e.g., silicon has excellent thermal conductivity, all the head chips 10*a* have substantially the same temperature. If the semiconductor substrate 11 cannot effectively radiate heat, it readily heats up.

However, by sharing a single nozzle sheet 17 among all the head chips 10*a*, the head chips 10*a* can have substantially the same temperature. Since ink contained in the liquid storage chambers 13*b* for all the head chips 10*a* provides large thermal capacity and a large area for dissipating heat, the temperatures of the head chips 10*a* increase gradually, thereby suppressing increase in the temperatures of the head chips 10*a*. Hence, this suppresses bubbling of ink in the head chips 10*a*, particularly, between the individual flow paths 13*d* and the reservoirs 13*a*.

Figures 4A, 4B:
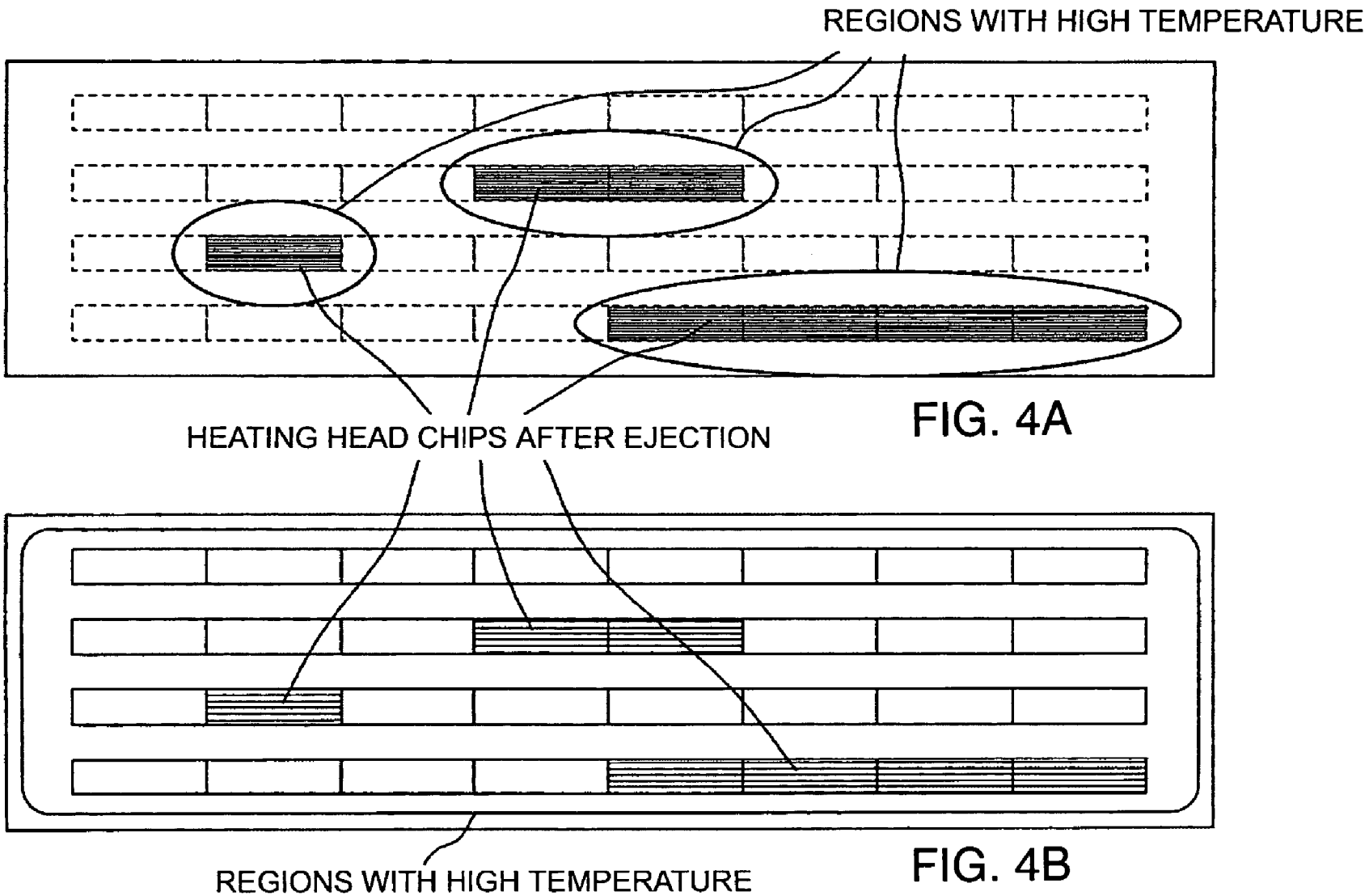
FIGS. 4A and 4B are plan views of four lines of the head chips for a color line head.

FIGS. 4A and 4B are plan views of four lines of the head chips 10*a* for a color line head. Heating head chips 10*a* are shown by hatching. The head chips having smaller gaps between hatching lines have higher temperatures.

The nozzle sheet 17 in FIG. 4A has low thermal conductivity, whereas the nozzle sheet 17 in FIG. 4B has high thermal conductivity. In the nozzle sheet 17 in FIG. 4A, the temperatures of the heating head chips 1*a* are particularly increased. By contrast, in the nozzle sheet 17 in FIG. 4B, heat from the heating head chips 10*a* is transmitted over the nozzle sheet 17 and thus the temperatures of all the head chips 10*a* are substantially the same, that is, the operational conditions of all the head chips 10*a* are substantially the same.

The head 10 and the liquid ejection apparatus including the head 10 such as an inkjet printer according to the first embodiment have the following advantages.

(1) When a distance Yn from the center of the heating element 12 to the left side surface of the head chip 10*a* in contact with the common flow path is large, nucleate boiling utilizing bubble nuclei in irregularities on the left side surface of the head chip 10*a* is prevented, that is, bubbles are not generated. Furthermore, with the aforementioned structure of the first embodiment, the operational temperature of the head chips 10*a* can be lower than that of the head chips 1*a* of a known type under the same conditions. Therefore, in order to maintain the same temperature as that of the head chips 1*a* of a known type, the distance Yn of the head chip 10*a* can be made smaller than the distance Yn of the head chip 1*a* of a known type.

(2) Even when the distance Yn is not made small in the head chip 10*a*, the operational temperature of the head chip 10*a* having the aforementioned structure can be reduced and thus nucleate boiling hardly ever occurs. That is, the head chip 10*a* of the first embodiment has a tolerance to a temperature increase.

(3) According to the first embodiment of the present invention, since a chance for nucleate boiling to occur on the left side surface of the head chip 10*a* is decreased, frequency for ink ejection can be increased. Therefore, the cycle of ejection and refill can be shortened and thus the head chip 10*a* can realize high-speed printing.

(4) When the head 10 is used as a line head including lines of the head chips 10*a*, the operational temperatures of all the head chips 10*a* are maintained substantially the same in the head 10. Accordingly, variations in the amount of ejected ink due to a temperature change become small and thus unevenness of ink density in printing is suppressed.

Second Embodiment

Figure 5B:
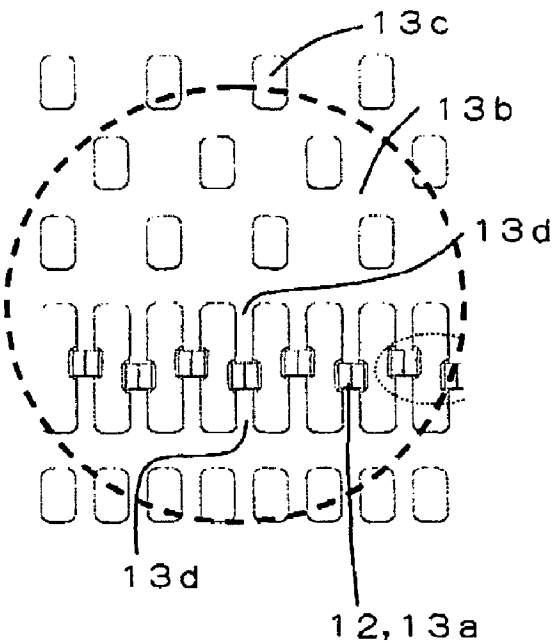
FIG. 5B is a detailed view of the portion circled in FIG. 5A.
Figure 5A:
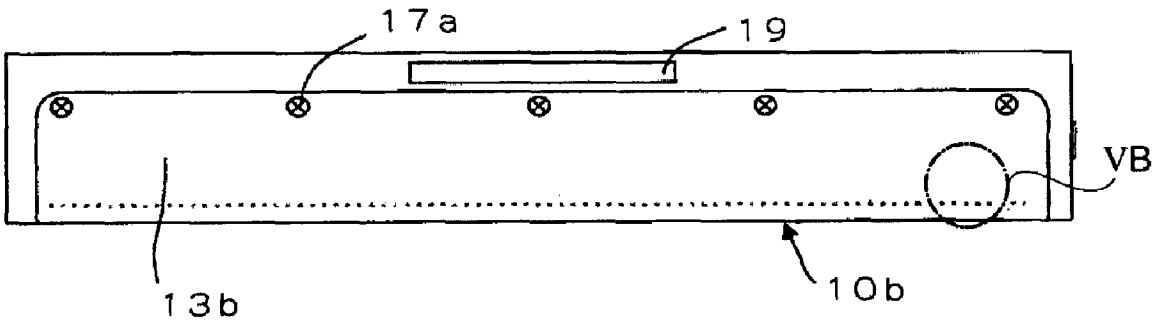
FIG. 5A is a plan view of a head chip according to a second embodiment.

FIG. 5A is a plan view of a head chip 10*b* according to a second embodiment and FIG. 5B is a detailed view of the portion circled in FIG. 5A. The head chip 10*b* is different from the head chip 10*a* shown in FIGS. 2B and 2C in that reservoirs 13*a* communicate with a liquid storage chamber 13*b* distant from a common flow path. Referring to FIG. 5B, heating elements 12 are disposed in one direction at a constant pitch. However, the heating elements 12 are misaligned, that is, a gap (a real number greater than zero) is disposed between the centers of the adjacent heating elements 12 (nozzles 18) in the direction orthogonal to the direction along which the heating elements 12 are disposed.

Accordingly, the distance between the centers of the adjacent nozzles 18 is greater than the pitch at which the heating elements 12 (nozzles 18) are arranged. Ink in the nozzles 18 and in the vicinity of the nozzles 18 is hardly influenced by the pressure change due to ejection of ink drops and thus an amount of ejected ink-drops and a direction of ejection can be stabilized. This technique has already been proposed by this assignee in Japanese Unexamined Patent Application Publication No. 2003-383232.

Barrier layers 13 having substantially rectangular shapes in plan view are disposed on both sides of the heating elements 12 in the direction along which the heating elements 12 are disposed. Individual flow paths 13*d* are disposed between the barrier layers 13 on both sides of the heating elements 12 in the direction orthogonal to the direction along which the heating elements 12 are disposed, namely, on the common flow path side and the side opposite from the common flow path side. The individual flow paths 13*d* disposed close to the liquid storage chamber 13*b* communicate with the liquid storage chamber 13*b*.

According to the second embodiment, although the individual flow paths 13*d* directly connect the reservoirs 13*a* to the liquid storage chamber 13*b*, ink does substantially not flow in the liquid storage chamber 13*b* except in the vicinity of the reservoirs 13*a*.

Third Embodiment

Figure 6:
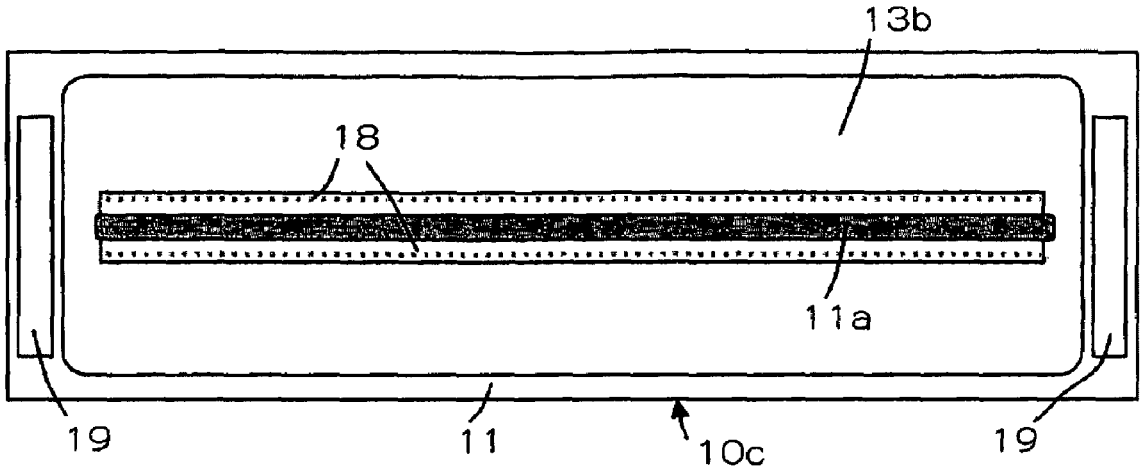
FIG. 6 is a plan view of a head chip according to a third embodiment of the present invention.

FIG. 6 is a plan view of a head chip 10*c* according to a third embodiment of the present invention. The head chip 10*c* is employed in a serial head. The third embodiment is different from the above embodiments in that connecting-electrode regions 19 are disposed on both sides on the head chip 10*c* in the longitudinal direction. According to the third embodiment, a liquid-supply slit 11*a* is disposed in the center area of the head chip 10*c*. The liquid-supply slits 11*a* may be disposed on both sides of the head chip 10*c*. In the third embodiment, since the positions of the connecting-electrode regions 19 are different, a liquid storage chamber 13*b* can be provided in the serial head with high efficiency. Although not illustrated in FIG. 6, the structures of the reservoirs 13*a* and the liquid storage chamber 13*b* according to the third embodiment may be any of those described in the above embodiments.

EXAMPLES

Figure 22:
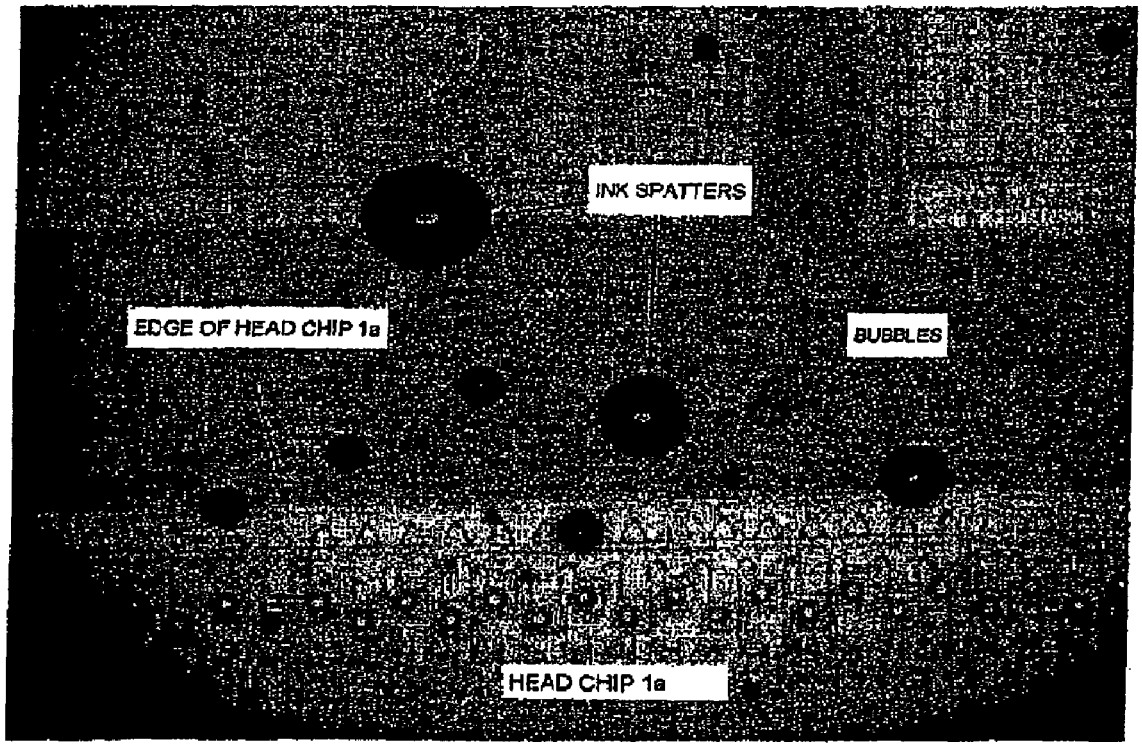
PRIOR ART FIG. 22
FIG. 22 is an enlarged photograph of the known head, showing a state in which bubbles are generated in the head immediately after an ink drop is ejected.
Figure 23:
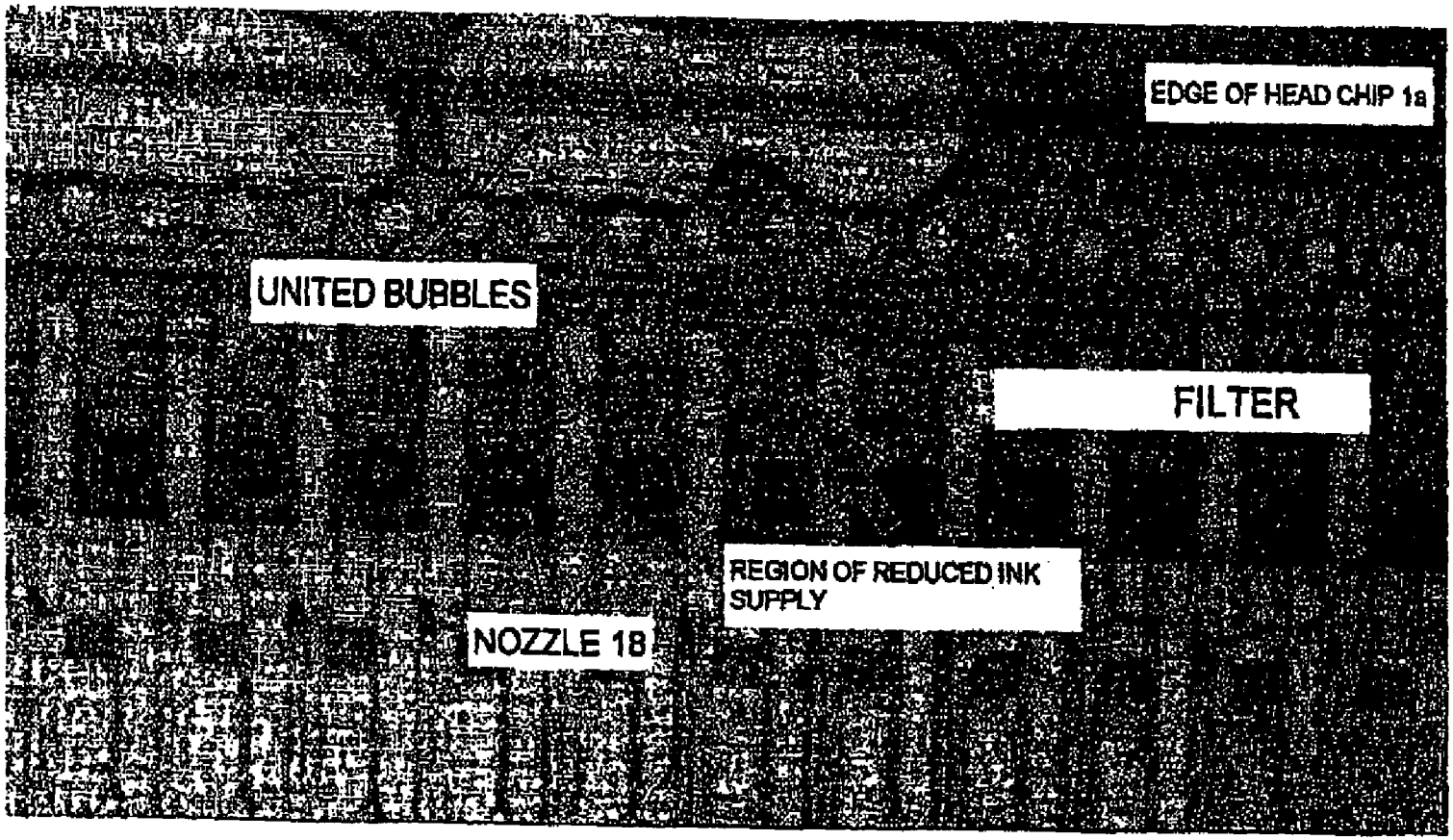
PRIOR ART FIG. 23
FIG. 23 is an enlarged photograph of a part of the known head where large bubbles are generated due to lack of ink supply.
Figure 24:
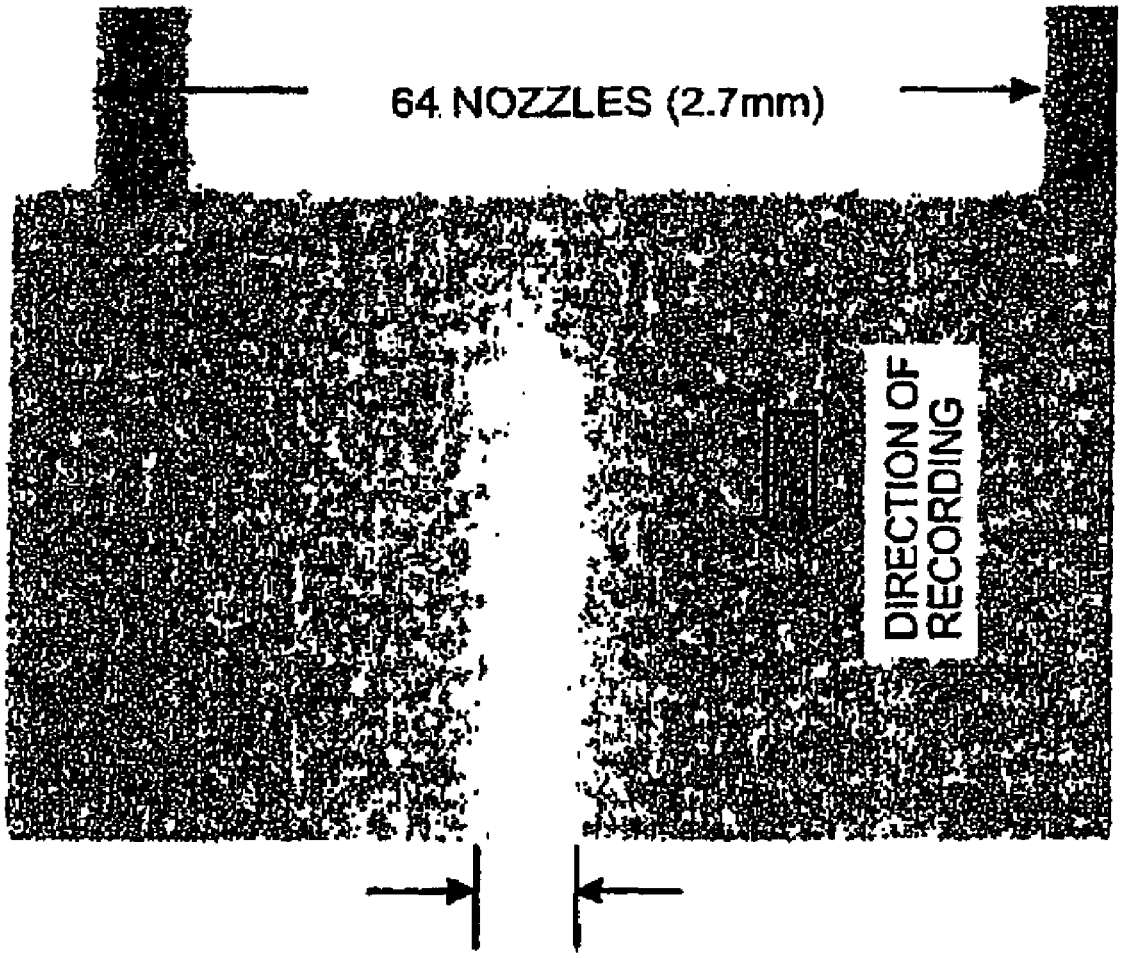
PRIOR ART FIG. 24
FIG. 24 is an enlarged photograph of a line head, showing a white line formed due to lack of ink supply to the reservoirs caused by the generation of bubbles.

Examples of the present invention will now be described. A head 1 of a known type including the head chip 1*a* and heads 10 according to Examples 1 and 2 including the head chips 10*b* of the second embodiment, shown in FIG. 5, were fabricated for comparison. The head 1 of a known type and the heads 10 of Examples 1 and 2 had the same specifications as the head shown in FIG. 22. FIG. 7 shows the specifications of the head 1 and the heads 10. In the heads 1 and 10, the nozzles 18 were arranged such that the centers of the adjacent nozzles 18 were misaligned in the direction orthogonal to the direction along which the nozzles 18 were arranged. The gap between the centers of the adjacent nozzles 18 was half the pitch of the nozzles 18.

Figure 8:
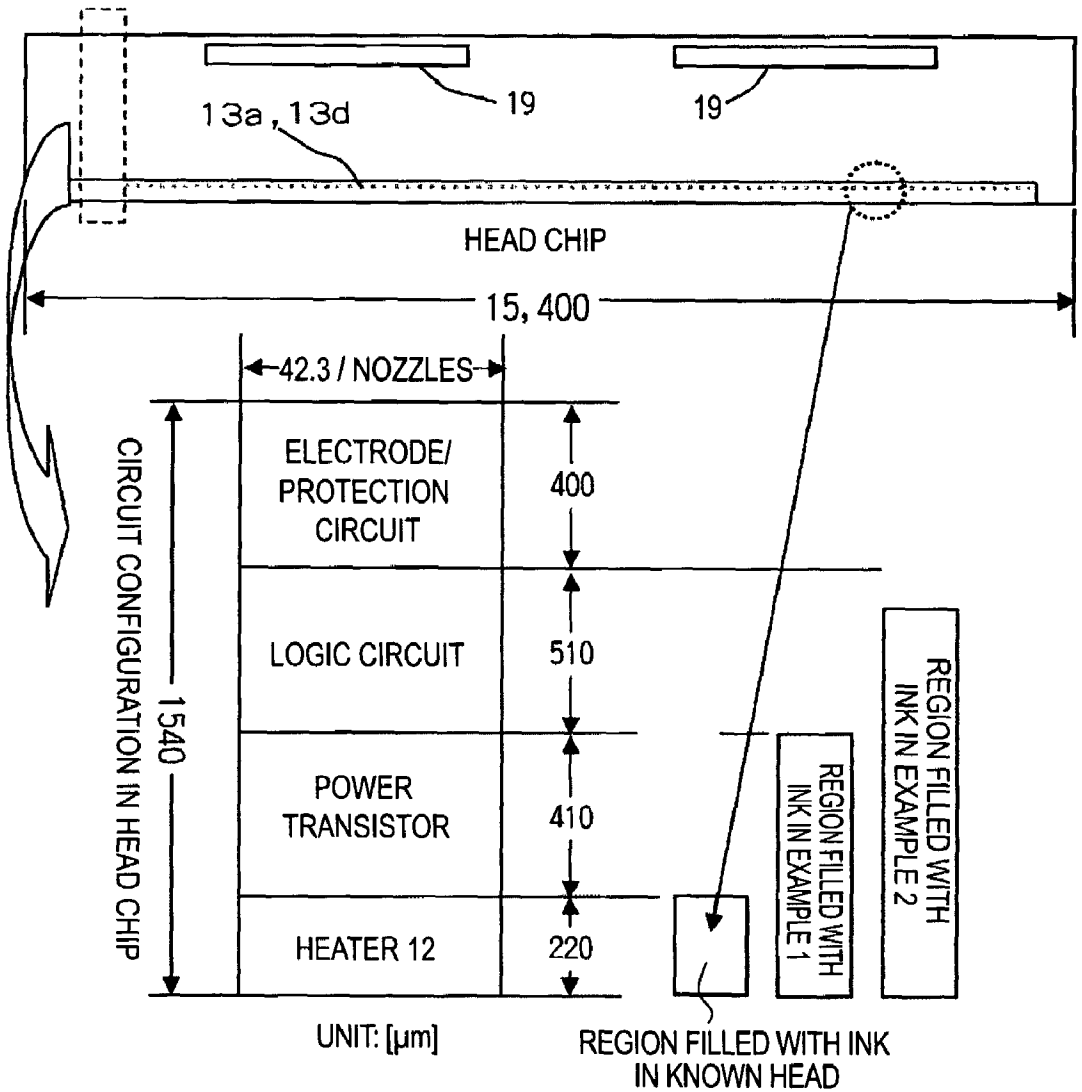
FIG. 8 is a schematic view showing a space distribution of effective circuits in the known head chip and the head chips of Examples 1 and 2.

FIG. 8 shows a space distribution of circuits in the head chip 1*a* and the head chips 10*b*. In the head chip 10*b* according to Example 1, the liquid storage chamber 13*b* was formed so as to have the same height as the height of a power transistor. In the head chip 10*b* according to Example 2, the liquid storage chamber 13*b* was formed so as to have the same height as the sum of the heights of the power transistor and a logic circuit. The head chip 1*a* of a known type and the head chips 10*b* of Examples 1 and 2 each have a width of 15,400 μm and a length of 1,540 μm. According to the head chip 1*a*, only a region on the heating elements 12, i.e., the reservoirs 3*a* were filled with ink. That is, the range with a height of 220 μm was filled with ink in the head chip 1*a*. According to Example 1, a region on the heating elements 12 and the liquid storage chamber 13*b* having a length corresponding to that of the power transistor were filled with ink. That is, a range with a length of 630 μm (220 μm+410 μm) was filled with ink in Example 1. According to Example 2, a region on the heating elements 12 and the liquid storage chamber 13*b* having a length corresponding to the sum of the lengths of the power transistor and the logic circuit were filled with ink. That is, a range with a length of 1,140 μm (220 μm+410 μm+510 μm) was filled with ink in Example 2. Since the difference in results of Example 1 and Example 2 was negligible, they are collectively referred to as an example hereinbelow.

The length of the region filled with ink in the head chip 10*b* according to the example was approximately three times that of the head chip 1*a*. In the head chip 1*a* and the head chip 10*b*, the barrier layer 3 and the barrier layer 13 were bonded to the nozzle sheets 17 over a large contact area in the vicinity of the nozzles 18 such that the barrier layer 3 and the barrier layer 13 were not separated from the nozzle sheets 17 by pressure applied for ink ejection. Thus, the areas of the nozzle sheets 17 in contact with ink in the vicinity of the nozzles 18 were relatively small in both the head chip 1*a* and the head chip 10*b*. Consequently, the area in the nozzle sheet 17 in contact with ink in the head chip 10*b* was substantially four or five times that of the head chip 1*a*.

To compare temperature increase in the head 1 and the head 10, the following method can be employed. The head chip 1*a* and the head chip 10*b* are operated for the same period of time (the same number of print sheet), i.e., 20 sheets of A4 size paper to print the same material, i.e., a monochrome dot pattern with a printing rate of 20%, and temperature increase in both heads is measured. However, the heads are provided with no means for measuring the temperatures of the interiors thereof. Therefore, first of all, bubbling was compared in the head 1 and the head 10.

To observe the interiors of the heads, transparent nozzle sheets 17 composed of a polymeric material (polyimide) having a thickness of 25 μm were used in experiments, instead of nozzle sheets formed with nickel by electroforming.

Figure 9:
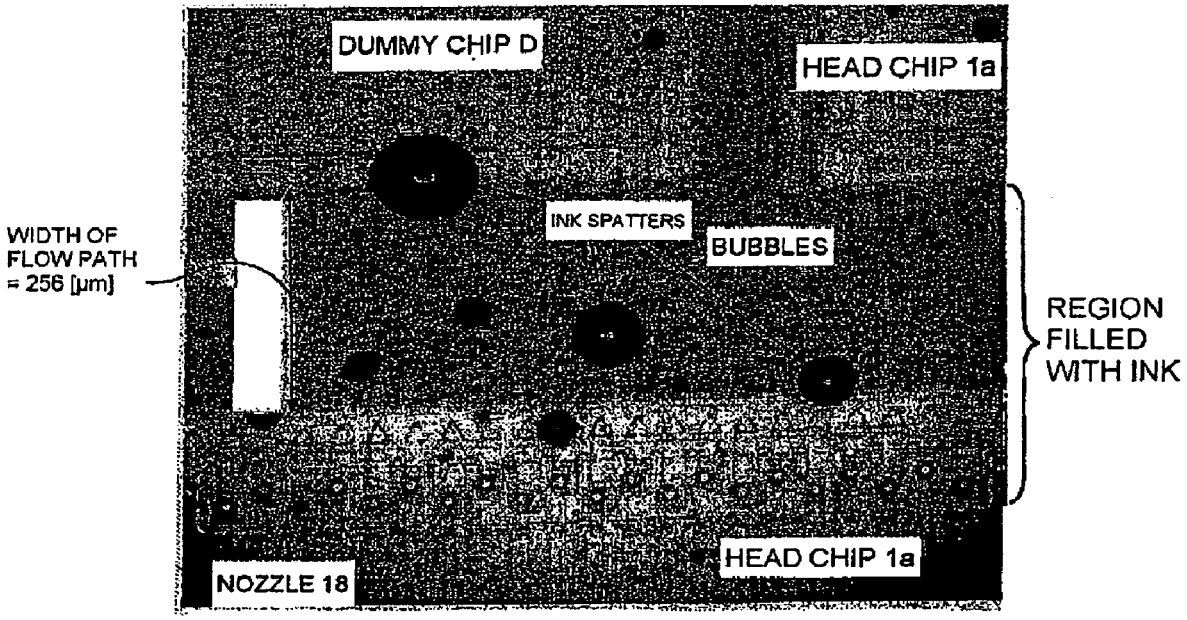
PRIOR ART FIG. 9
FIG. 9 is a photograph of the known head.
Figure 10:
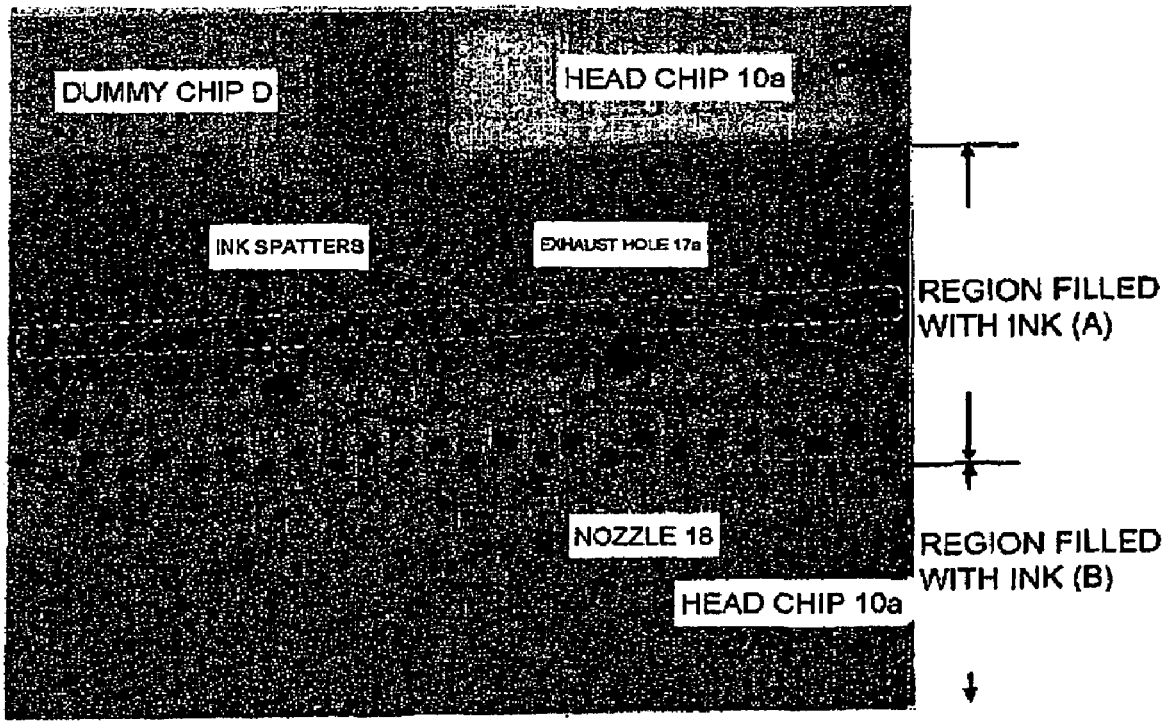
PRIOR ART FIG. 10
FIG. 10 is a photograph of the head according to an example of the present invention.

FIG. 9 is a photograph of the head 1, whereas FIG. 10 is a photograph of the head 10. In FIGS. 9 and 10, the heads 1 and 10 (print head blocks) were taken out immediately after printing, and photographs of the heads 1 and 10 using magenta ink were taken from below (from the recording medium side). Referring to FIG. 9, bubbles were generated along the head chip 1*a* but no bubble developed on the dummy chip D disposed opposite from the head chip 1*a*.

Normally, these bubbles are relatively stabilized and thus will disappear when temperatures around the bubbles decrease. However, with the head 1 of a known type, some of the bubbles were united with other bubbles generated at a later time, and it took several hours for all the bubbles to disappear.

By contrast, referring to FIG. 10, no bubble was observed in the head 10. Experimentally, the exhaust holes 17*a* were disposed along the edge of the head chip 10*b* for every two nozzles in the head 10. It was, however, apparent that bubbles were not discharged through these exhaust holes 17*a* from the following reasons.

When a lot of bubbles are generated, the exhaust holes 17*a* can effectively reduce bubbles. As can be understood from FIG. 9, normally the size of the bubbles ranges from a small bubble that has just developed and a large bubble that has been united with another bubble. Considering this, it is unlikely that all bubbles were discharged through the exhaust holes 17*a* immediately after they developed. This concludes that no bubble was generated in the head 10 shown in FIG. 10. These results confirmed that the temperature increase can be effectively suppressed in the thermal liquid ejection head (head chip) of the present invention.

As described above, it is difficult to accurately measure the temperatures of the interiors of the head chips 1*a* and 10*b*. The head chips 1*a* and 10*b* were, however, provided with the connecting-electrode regions 19 (e.g., 14 electrodes). The electrodes were connected to outside components through metal bonding wires. That is, bonding terminals were directly connected to the head chips 1*a* and 10*a*. The temperatures of the vicinities of the bonding terminals were proximate to those of the interiors of the head chips 1*a* and 10*a*. Therefore, the temperatures of the surfaces of the bonding terminals were measured.

Figure 11:
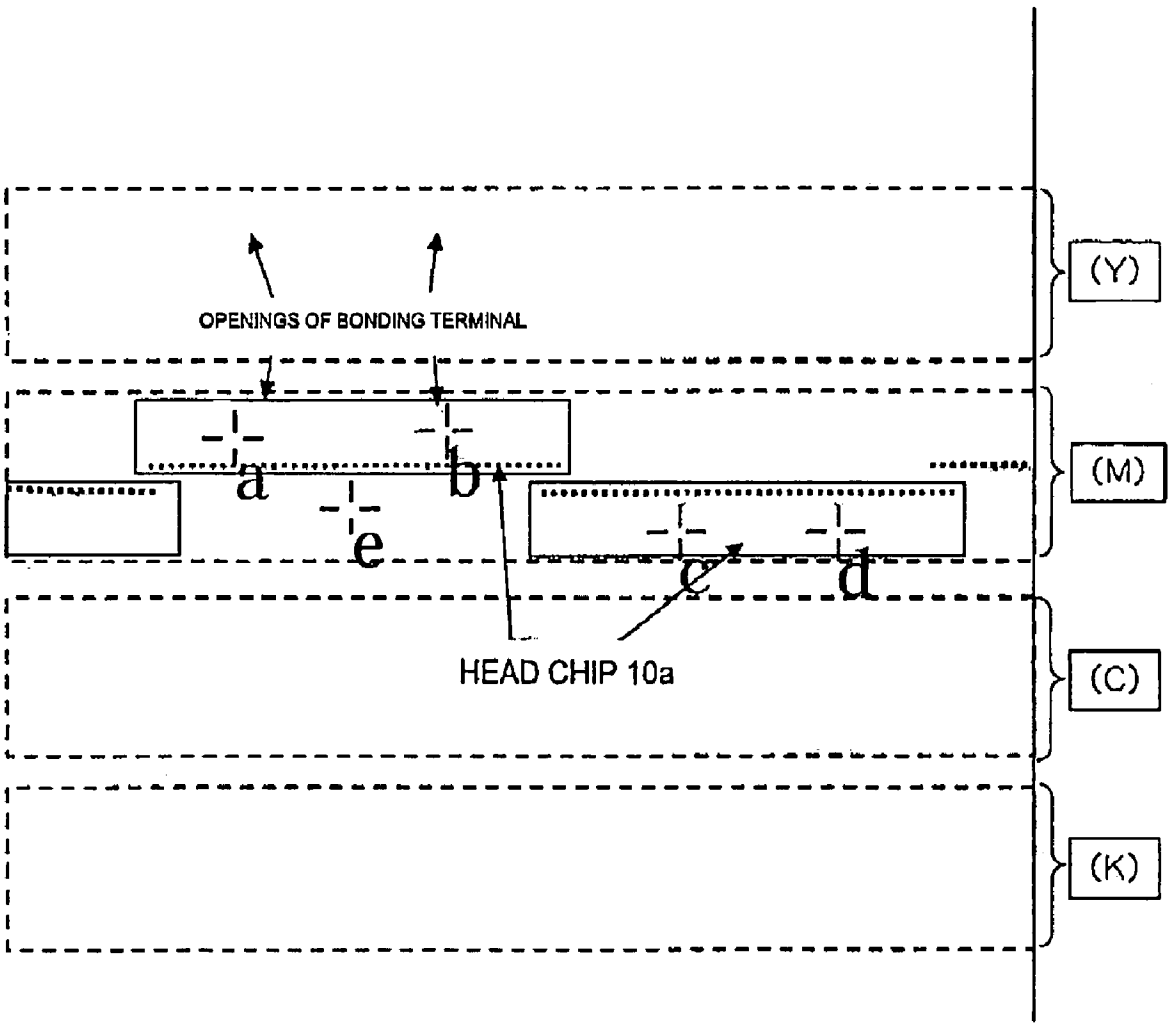
FIG. 11 is a photograph showing the states of the nozzle sheet and the vicinities of the openings of the bonding terminals during measurement of temperatures.

FIG. 11 is a photograph showing a state of the nozzle sheet 17 and the vicinities of openings of the bonding terminals during measurement of the temperatures. The photograph in FIG. 11 was obtained using an infrared camera and a thermal image-processing program. The structures of the bonding terminals of the head chip 1*a* were the same as those of the head chip 10*b*. Cross-shaped markings designated by a, b, c, d, and e were points where temperatures were measured.

Figure 13:
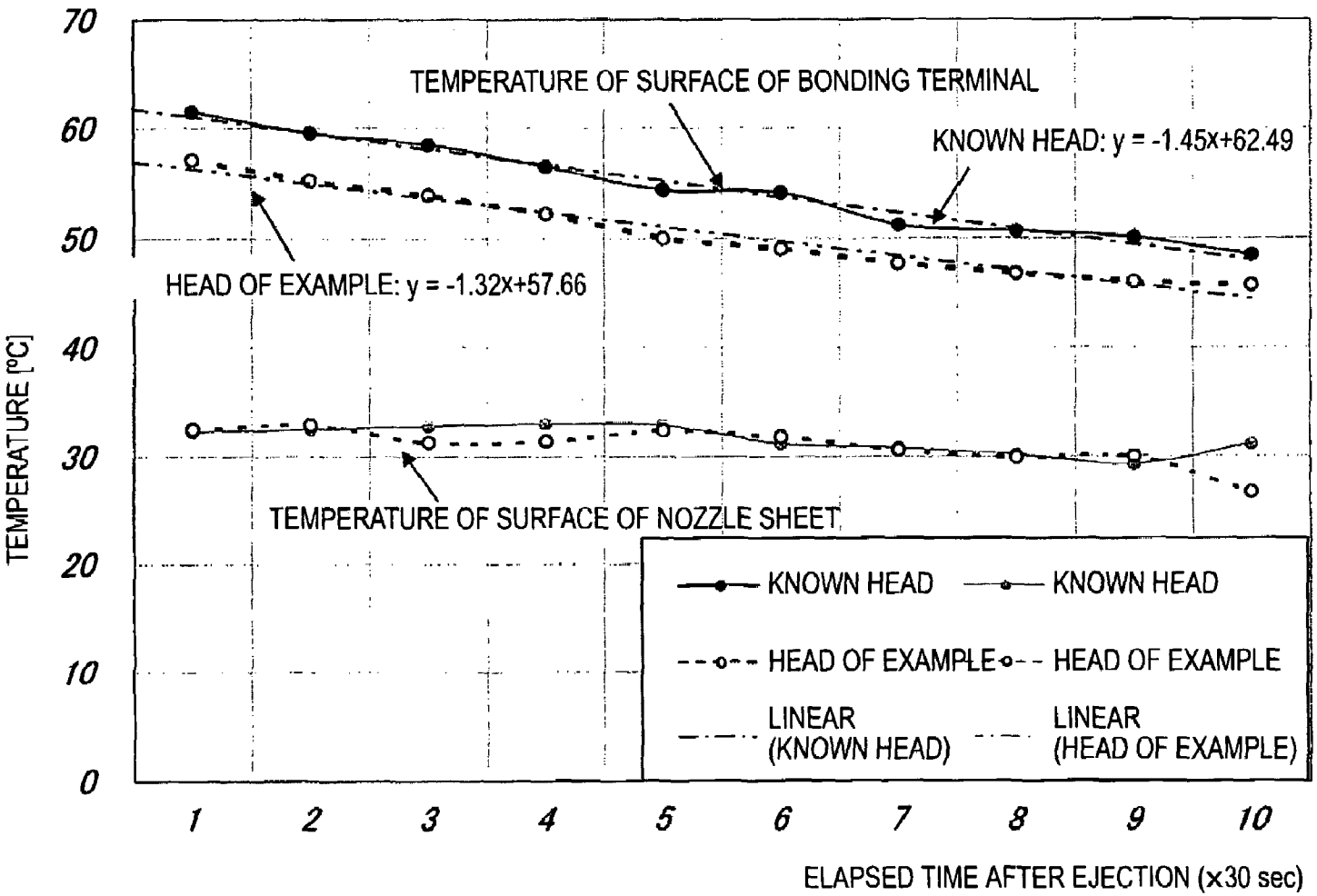
FIG. 13 is a graph of the measured temperatures in FIG. 12.

FIG. 12 shows the temperatures measured by the aforementioned method. FIG. 13 is a graph of the measured temperatures in FIG. 12. The temperatures of the surfaces of the bonding terminals in two sets of opposing head chips la and head chips 10*a* were measured at the points a, b, c, and d marked with long circles and the mean values were calculated. The temperature of the surface of the nozzle sheet 17 was measured at the point e in FIG. 11. FIG. 13 includes equations for the temperatures of the surfaces of the bonding terminals.

Referring to FIGS. 12 and 13, the temperatures of the surfaces of the bonding terminals in the head chip 10*a* were lower than those in the head chip 1*a* by about 5° C. (62.49–

57.66=4.83). Accordingly, if a certain point in the head chip 1*a* has a temperature of 100° C., the temperature of the same point in the head chip 10*a* will be at least 7° C. lower than 100° C. Since bubbles are generated at 100° C., bubbling of the head chip 10*a* is lower than that of the head chip 1*a*. Furthermore, the temperature of the surface of the nozzle sheet 17 in the head chip 10*a* was almost the same as that in the head chip 1*a*.

Next, cooling effects of the head 1 and the head 10 were compared using equivalent circuits. The states of the heads can be represented by simple electric circuits by replacing the heating element 12 with a power supply, the thermal resistance (thermal conductivity) with electrical resistance, thermal capacitance for each component with a capacitor, and the temperature of a point of interest with a voltage. In an equivalent circuit in FIG. 14B, points P1-P4 have higher thermal conductivity than other parts in the components to which points P1-P4 belong. These components having points P1-P4 have the same temperatures as those of respective points P1-P4, that is, points P1-P4 can be considered as equipotential points in the equivalent circuit. More specifically, a point P1 is at the surface of the heating elements 12, and the temperature thereof can be measured, reading approximately 350° C. at all times. A point P2 is at the surface of the semiconductor substrate 11 and needs to be measured. A point P3 is at the surface of the nozzle sheet 17 and can be measured since the nozzle sheet 17 is exposed. A point P4 is at the surface of the channel plate 22 and can be measured since the channel plate 22 is exposed. However, the point P4 is unnecessary in a simplified equivalent circuit in FIG. 14C, which will be described in detail below.

Figures 14A, 14B, 14C:
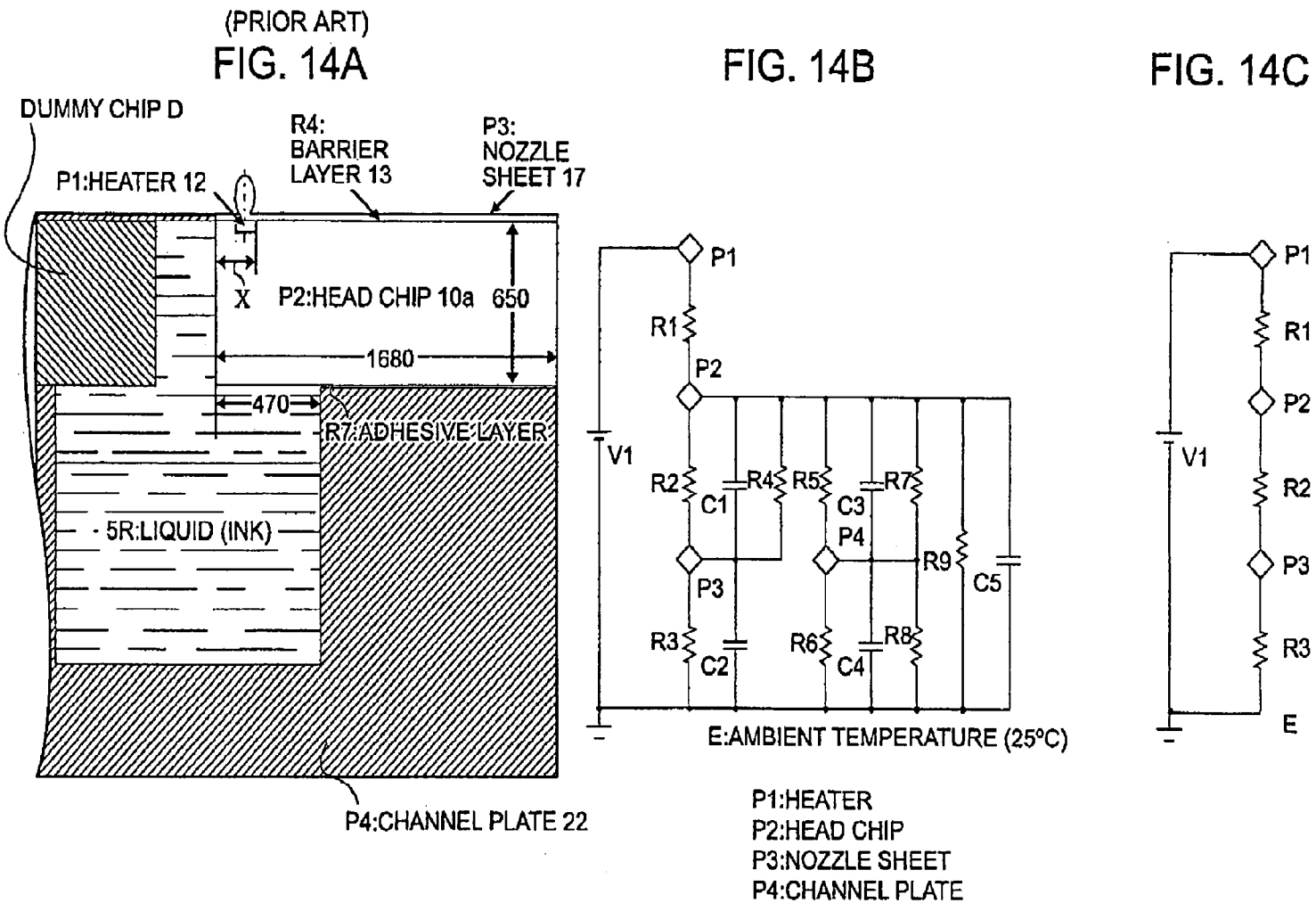
(PRIOR ART) FIG. 14A
FIG. 14A is a schematic drawing of the known head.
FIG. 14B is an equivalent circuit of a head.
FIG. 14C is a simplified equivalent circuit of a head.

Considering a transient state where the overall temperature of the head is not stabilized, thermal capacity needs to be taken into consideration and thus the equivalent circuit becomes complex, as shown in FIG. 14B. However, a state where the head is operated long enough and thus the temperature of the head is stabilized can be represented by a simplified equivalent circuit, as shown in FIG. 14C. FIG. 15 is a table showing grounds that errors are negligible in the simplified equivalent circuit in FIG. 14C.

Using the observed temperatures shown in FIG. 12 and the simplified equivalent circuit shown in FIG. 14C, the cooling effects of the head 1 and the head 10 were compared. Only parameters differ between the heads 1 and 10 were R2 and R3. Therefore, R2 and R3 of the head 1 were replaced with R2' and R3' in the head 10. The temperature of the point P1 was maintained at 350° C. in both heads since a constant temperature was required for ink ejection. The temperature of the point P2 was 62.5° C. (the number to the second decimal place was round off in the equation for the head 1 in FIG. 13) in the head 1 during operation. The temperature of the point P2 was 57.7° C. in the head 10 during operation. The temperature of the point P3 was about 32.4° C. in the both heads. The temperatures of the heads were measured at ambient temperature of 25° C. The ratio R1/(R2+R3) was calculated from Equation 1:

$$R1/(R2+R3)=(350-62.5)/(62.5-25)=287.5/37.5. \quad \text{Equation 1}$$

The only difference in the head 1 and the head 10 was the structure of the barrier layers 3 and 13, and the rest of the structures including the head chip 1*a* and the head chip 10*b* were the same. Therefore, in the head 10, R1 was the same as that of the known head. The temperature change at the point P2 was caused by the change in R2 and R3. Therefore, as described above, R2 and R3 in Equation 1 were replaced with R2' and R3' in Equation 2 for the head 10. The ratio R1/(R2'+R3') was calculated from Equation 2:

$$R1/(R2'+R3')=(350-57.7)/(57.7-25)=292.3/32.7. \quad \text{Equation 2}$$

From Equations 1 and 2, the ratio (R2'+R3')/(R2+R3) was calculated by the following Equation 3:

$$(R2'+R3')/(R2+R3)\approx 0.86 \quad \text{Equation 3}$$

The temperature on the surface of the nozzle sheet 17 of the head 1 was the same as that of the head 10. The ratios R2/R3 and R2'/R3' were calculated by the following Equation 4 and Equation 5:

$$R2/R3=(62.5-32.4)/(32.4-25)=4.07 \quad \text{Equation 4}$$

$$R2'/R3'=(57.7-32.4)/(32.4-25)=3.42 \quad \text{Equation 5}$$

Substitution of R2=4.07×R3 from Equation 4 and R2'=3.42×R3' from Equation 5 into Equation 3 yielded (1+3.42)R3'/(1+4.07)R3=0.86. From this, the ratio R3'/R3 was calculated by the following Equation 6:

$$R3'/R3=0.99 \quad \text{Equation 6}$$

Similarly, by substituting R3=R2/4.07 from Equation 4 and R3'=R2'/3.42 from Equation 5 into Equation 3, the ratio R2'/R2 was calculated by the following Equation 7:

$$R2'/R2=0.83. \quad \text{Equation 7}$$

The results of Equations 6 and 7 confirmed that the head 1 and the head 10 equally dissipated heat from the nozzle sheet 17, but the efficiency to transmit heat to the nozzle sheet 17 in the head 10 was improved by about 17% as compared to the head 1.

Figure 16:
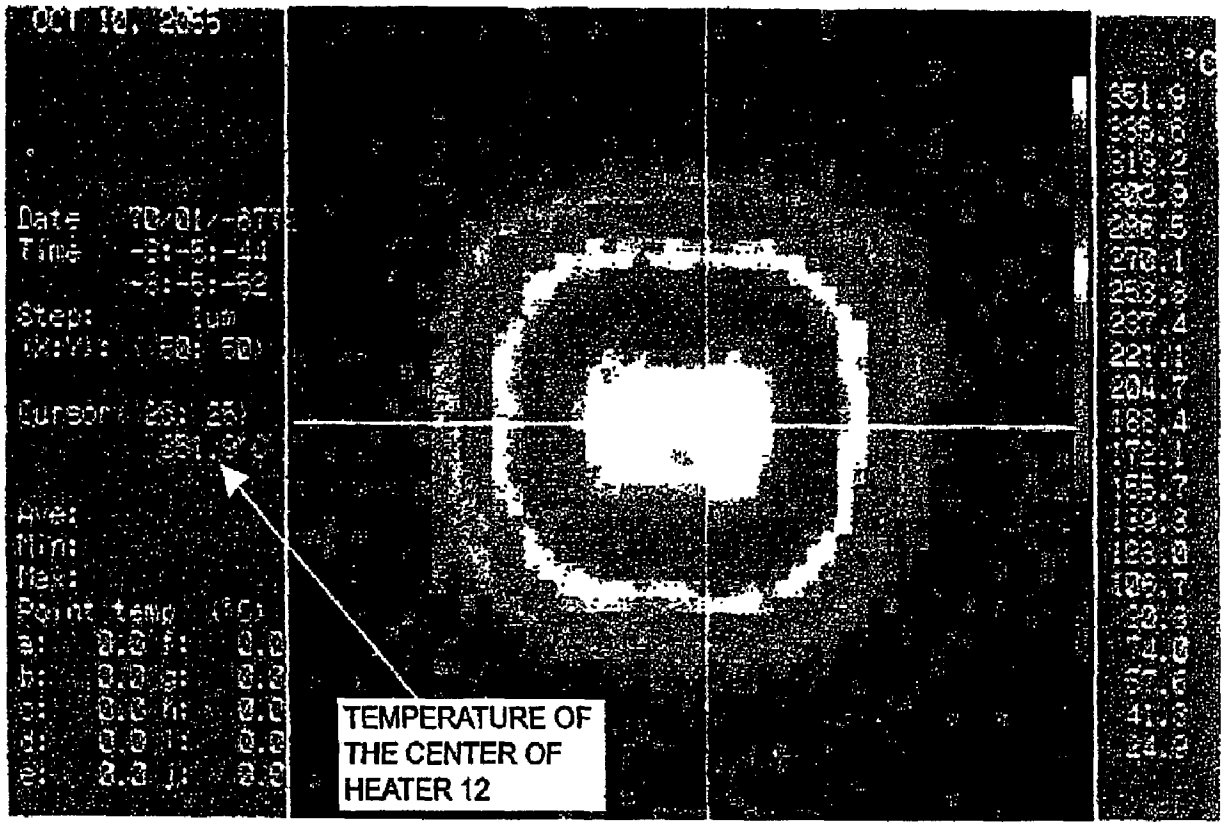
PRIOR ART FIG. 16
FIG. 16 is a photomicrograph of a head using no ink.

Even though the region filled with ink in the head 10 had an area several times larger than that of the head 1, the efficiency to transmit heat to the nozzle sheet 17 was improved only by about 17%. This may be caused by the fact that when ink was supplied, hardly any ink moved in the liquid storage chamber 13*b*, whereas a fairly large amount of ink moved in the heating elements 12 in the heads 1 and 10. FIG. 16 is a photomicrograph of a head using no ink, showing grounds that the temperature of the surface of the heating element 12 was fixed to 350° C. in the above experiments.

What is claimed is:

1. A liquid ejection head comprising:

at least one head chip including a plurality of heating elements on a first surface of a substrate;

a nozzle layer having nozzles correspondingly disposed above respective heating elements and in a facing relation with said heating elements;

a barrier layer selectively disposed between the head chip and the nozzle layer;

a plurality of individual ink ejection reservoirs, each disposed between a heating element and a respective nozzle, the reservoirs being defined, at least in part, by the barrier layer;

a common flow path communicating with the reservoirs and supplying liquid to the reservoirs, the common flow path extending in a depth direction of the head chip beyond the plane of the individual reservoirs and at least along one longitudinal end of the substrate; and a liquid storage chamber disposed on at least one region of the first surface of the substrate excluding a region on which the reservoirs are disposed, the liquid storage chamber being defined, at least in part, by the barrier layer, the liquid storage chamber communicating with the reservoirs at least indirectly via the common flow path, the liquid storage chamber storing liquid such that part of the nozzle layer is in contact with the liquid, wherein heating energy is applied to the heating elements to generate bubbles in the liquid contained in the reservoirs, and the generated bubbles expel liquid in the reservoirs through the nozzles.

2. The liquid ejection head according to claim 1, wherein the nozzle layer comprises a single metal unit.

3. The liquid ejection head according to claim 1, wherein the liquid ejection head comprises a plurality of the head chips arranged adjacent one another such that the liquid ejection head constitutes a line head, wherein the head chips are disposed along the common flow path so as to direct openings of the individual ink ejection reservoirs toward the common flow path and the liquid storage chamber is disposed at least in a same plane as the individual ink ejection reservoirs but on an opposite side of the ink ejection reservoirs as the direction in which the reservoir openings face towards the common flow path.

4. The liquid ejection head according to claim 1, wherein the reservoirs cover the heating elements and have openings on the side connected to the common flow path, and the liquid storage chamber communicates with the common flow path at edges of the liquid storage chamber in the longitudinal direction of the head chip.

5. The liquid ejection head according to claim 1, wherein at least one exhaust hole passes through a region in the nozzle layer over the liquid storage and the exhaust hole provides direct communication between the liquid storage chamber and the outside of the liquid ejection head.

6. The liquid ejection head according to claim 5, wherein an area of the exhaust hole is smaller than an area of each nozzle on said surface of the nozzle layer such that the exhaust holes allow air to pass therethrough but prevent ink from passing therethrough.

7. The liquid ejection head according to claim 1, wherein said barrier layer provides a barrier between the individual ink ejection reservoirs and the liquid storage chamber in the plane of the liquid storage chamber and individual ink ejection reservoirs, and wherein said liquid storage chamber and said individual ink ejection reservoirs and connected only indirectly via said common flow path extending in a depth direction.

8. The liquid ejection head according to claim 7, further comprising column posts provided intermittently in the area of the liquid storage chamber and which provide contact between the nozzle layer and the barrier Layer.

9. The liquid ejection head according to claim 7, wherein, when the heating elements are driven and ink is ejected from respective individual ink ejection reservoirs, wherein a substantial portion of the flowing into the individual ink reservoir to replace the ink ejected is provided from the common flow path, and such that hardly any ink moves in the liquid storage chamber.

10. The liquid ejection head according to claim 1, wherein said common flow path extends across a second surface of the substrate opposite the first surface of the substrate.

11. The liquid ejection head according to claim 1, wherein said individual ink ejection reservoirs contain an opening facing the common flow path and an opening in the opposite direction facing the liquid storage chamber, such that the individual ink ejection reservoirs communicate directly with the liquid storage chamber via said openings, and communicate with the liquid storage chamber indirectly via said common flow path extending in the depth direction.

12. The liquid ejection head according to claim 1, further comprising column posts provided intermittently in the area of the liquid storage chamber and which provide contact between the nozzle layer and the barrier layer.

13. The liquid ejection head according to claim 1, wherein, when the heating elements are driven and ink is ejected from respective individual ink ejection reservoirs, wherein a substantial portion of the flowing into the individual ink reservoir to replace the ink ejected is provided from the common flow path, and such that hardly any ink moves in the liquid storage chamber.

14. A liquid ejection apparatus comprising a liquid ejection head comprising:

at least one head chip including a plurality of heating elements on a first surface of a substrate;

a nozzle layer having nozzles correspondingly disposed above respective heating elements and in a facing relation with said heating elements;

a barrier layer selectively disposed between the head chip and the nozzle layer;

a plurality of individual ink ejection reservoirs, each disposed between a heating element and a respective nozzle, the reservoirs being defined, at least in part, by the barrier layer;

a common flow path communicating with the reservoirs and supplying liquid to the reservoirs, the common flow path extending in a depth direction of the head chip beyond the plane of the individual reservoirs and at least along one longitudinal end of the substrate; and a liquid storage chamber disposed on at least one region of the first surface of the substrate excluding a region on which the reservoirs are disposed, the liquid storage chamber being defined, at least in part, by the barrier layer, the liquid storage chamber communicating with the reservoirs at least indirectly via the common flow path, the liquid storage chamber storing liquid such that part of the nozzle layer is in contact with the liquid, wherein healing energy is applied to the heating elements to generate bubbles in the liquid contained in the reservoirs, and the generated bubbles expel liquid in the reservoirs through the nozzles.

15. The liquid ejection apparatus comprising a liquid ejection head according to claim 14, said liquid ejection head further comprising column posts provided intermittently in the area of the liquid storage chamber and which provide contact between the nozzle layer and the barrier layer, wherein said barrier layer provides a barrier between the individual ink ejection reservoirs and the liquid storage chamber in the plane of the liquid storage chamber and individual ink ejection reservoirs, and wherein said liquid storage chamber and said individual ink ejection reservoirs and connected only indirectly via said common flow path extending in a depth direction.

16. A method of forming an image on a printing medium via ink ejection comprising the steps of:

providing at least one head chip including a plurality of heating elements on a first surface of a substrate;

providing a nozzle layer having nozzles correspondingly disposed above respective heating elements and in a facing relation with said heating elements;

forming a barrier layer selectively disposed between the head chip and the nozzle layer;

forming a plurality of individual ink ejection reservoirs, each disposed between a heating element and a respective nozzle, the reservoirs being defined, at least in part, by the barrier layer;

providing a common flow path communicating with the reservoirs and supplying liquid to the reservoirs, the common flow path extending in a depth direction of the head chip beyond the plane of the individual reservoirs and at least along one longitudinal end of the substrate;

providing a liquid storage chamber disposed on at least one region of the first surface of the substrate excluding a region on which the reservoirs are disposed, the liquid storage chamber being defined, at least in part, by the barrier layer, the liquid storage chamber communicating with the reservoirs at least indirectly via the common flow path, the liquid storage chamber storing liquid such that part of the nozzle layer is in contact with the liquid, and driving said liquid ejection head to ejection ink by applying a driving energy to the heating elements to generate bubbles in the liquid contained in the reservoirs, and the generated bubbles expel liquid in the reservoirs through the nozzles.

17. The method of forming an image on a printing medium via ink ejection according to claim 16, wherein said barrier layer provides a barrier between the individual ink ejection reservoirs and the liquid storage chamber in the plane of the liquid storage chamber and individual ink ejection reservoirs, and wherein said liquid storage chamber and said individual ink ejection reservoirs and connected only indirectly via said common flow path extending in a depth direction.

18. The method of forming an image on a printing medium via ink ejection according to claim 17, further comprising column posts provided intermittently in the area of the liquid storage chamber and which provide contact between the nozzle layer and the barrier layer.

19. The method of forming an image on a printing medium via ink ejection according to claim 17, wherein, when the heating elements are driven and ink is ejected from respective individual ink ejection reservoirs, wherein a substantial portion of the flowing into the individual ink reservoir to replace the ink ejected is provided from the common flow path, and such that hardly any ink moves in the liquid storage chamber.

20. The method of forming an image on a printing medium via ink ejection according to claim 16, wherein said common flow path extends across a second surface of the substrate opposite the first surface of the substrate.

21. The method of forming an image on a printing medium via ink ejection according to claim 16, wherein said individual ink ejection reservoirs contain an opening facing the common flow path and an opening in the opposite direction facing the liquid storage chamber, such that the individual ink ejection reservoirs communicate directly with the liquid storage chamber via said openings, and communicate with the liquid storage chamber indirectly via said common flow path extending in the depth direction.

22. The method of forming an image on a printing medium via ink ejection according to claim 16, further comprising column posts provided intermittently in the area of the liquid storage chamber and which provide contact between the nozzle layer and the barrier layer.

23. The method of forming an image on a printing medium via ink ejection according to claim 16, wherein, when the heating elements are driven and ink is ejected from respective individual ink ejection reservoirs, wherein a substantial portion of the flowing into the individual ink reservoir to replace the ink ejected is provided from the common flow path, and such that hardly any ink moves in the liquid storage chamber.

* * * * *